US009597718B2

(12) United States Patent
Yamane

(10) Patent No.: US 9,597,718 B2
(45) Date of Patent: Mar. 21, 2017

(54) MANUFACTURING METHOD AND MANUFACTURING APPARATUS OF SEAMLESS METAL PIPE

(71) Applicant: NIPPON STEEL & SUMITOMO METAL CORPORATION, Tokyo (JP)

(72) Inventor: Akihito Yamane, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/405,612

(22) PCT Filed: Jul. 18, 2013

(86) PCT No.: PCT/JP2013/069489
§ 371 (c)(1),
(2) Date: Dec. 4, 2014

(87) PCT Pub. No.: WO2014/017370
PCT Pub. Date: Jan. 30, 2014

(65) Prior Publication Data

US 2015/0306646 A1 Oct. 29, 2015

(30) Foreign Application Priority Data

Jul. 24, 2012 (JP) ..... 2012-163436

(51) Int. Cl.
*B21B 19/04* (2006.01)
*B21B 17/02* (2006.01)
(Continued)

(52) U.S. Cl.
CPC ..... *B21B 19/04* (2013.01); *B21B 17/02* (2013.01); *B21B 13/10* (2013.01); *B21B 17/00* (2013.01);
(Continued)

(58) Field of Classification Search
CPC ..... B21B 13/10; B21B 17/00; B21B 17/02; B21B 19/00; B21B 19/02; B21B 19/04;
(Continued)

(56) References Cited

U.S. PATENT DOCUMENTS

2008/0245120 A1* 10/2008 Iwamoto ..... B21B 37/78 72/10.1
2009/0308125 A1 12/2009 Yamane
2010/0251792 A1 10/2010 Yamane

FOREIGN PATENT DOCUMENTS

CN 101568395 A 10/2009
CN 101730597 A 6/2010
(Continued)

OTHER PUBLICATIONS

Chinese Office Action and Search Report, dated Jul. 27, 2015, for Chinese Application No. 201380036725.X, with a partial English translation thereof.
(Continued)

*Primary Examiner* — David B Jones
(74) *Attorney, Agent, or Firm* — Birch, Stewart, Kolasch & Birch, LLP

(57) ABSTRACT

A manufacturing method of a seamless metal pipe includes determining whether a preceding-stage stand group is used in outer diameter reduction or in thickness reduction of a hollow shell; and performing elongating on the hollow shell, into which a mandrel bar is inserted, based on the determination. In addition, in the elongating, when the preceding-stage stand group is used in the outer diameter reduction, the hollow shell is rolled in a state where an inner surface of the hollow shell does not come into contact with the mandrel bar in the preceding-stage stand group, and the hollow shell is rolled in a state where the inner surface of the hollow shell comes into contact with the mandrel bar in the succeeding-stage stand group.

3 Claims, 19 Drawing Sheets

(51) Int. Cl.

| | |
|---|---|
| *B21B 25/00* | (2006.01) |
| *B21B 19/02* | (2006.01) |
| *B21B 25/06* | (2006.01) |
| *B21B 17/00* | (2006.01) |
| *B21B 19/00* | (2006.01) |
| *B21B 13/10* | (2006.01) |
| *B21B 25/02* | (2006.01) |
| *B21B 17/04* | (2006.01) |
| *B21B 17/14* | (2006.01) |
| *B21B 37/78* | (2006.01) |

(52) U.S. Cl.
CPC ..... *B21B 17/04* (2013.01); *B21B 17/14* (2013.01); *B21B 19/00* (2013.01); *B21B 19/02* (2013.01); *B21B 25/00* (2013.01); *B21B 25/02* (2013.01); *B21B 25/06* (2013.01); *B21B 37/78* (2013.01); *B21B 2261/04* (2013.01); *B21B 2261/08* (2013.01)

(58) Field of Classification Search
CPC ..... B21B 25/00; B21B 25/02; B21B 25/06; B21B 2261/04; B21B 2261/08; B21B 17/04; B21B 17/14; B21B 37/78
See application file for complete search history.

(56) References Cited

FOREIGN PATENT DOCUMENTS

| | | | |
|---|---|---|---|
| JP | 58-196109 | A | 11/1983 |
| JP | 5-123730 | A | 5/1993 |
| JP | 2000-176527 | A | 6/2000 |
| JP | 2001-293503 | A | 10/2001 |
| JP | 2008-296250 | A | 12/2008 |
| SU | 1715455 | A1 | 2/1992 |
| SU | 1733131 | A1 | 5/1992 |

OTHER PUBLICATIONS

Extended European Search Report, dated Jan. 28, 2016, for European Application No. 13822082.7.
Russian Decision on Grant, dated Apr. 26, 2016, for Russian Application No. 2014152811, together with an English translation thereof.
International Search Report, mailed Aug. 13, 2013, issued in PCT/JP2013/069489.
Written Opinion of the International Searching Authority, mailed Aug. 13, 2013, issued in PCT/JP2013/069489.

* cited by examiner

MANUFACTURING METHOD AND MANUFACTURING APPARATUS OF SEAMLESS METAL PIPE

TECHNICAL FIELD OF THE INVENTION

The present invention relates to a manufacturing method and a manufacturing apparatus of a seamless metal pipe, and particularly, a manufacturing method and a manufacturing apparatus of a seamless metal pipe using a mandrel mill.

Priority is claimed on Japanese Patent Application No. 2012-163436, filed on Jul. 24, 2012, the content of which is incorporated herein by reference.

BACKGROUND ART

In a manufacturing method of a seamless metal pipe using a mandrel mill, first, a heated round billet is pierced by a piercing mill, and thus, a hollow shell is manufactured. A mandrel bar is inserted into the manufactured hollow shell. The hollow shell into which the mandrel bar is inserted is elongated by a mandrel mill. The elongated hollow shell is heated as needed and is reduction-rolled by a sizing mill or a stretch reducing mill. According to the above-described processes, a seamless metal pipe is manufactured.

In the manufacturing method of a seamless metal pipe, seamless metal pipes having various steel grades and sizes (outer diameter and thickness) are manufactured. Accordingly, improvement of production efficiency is required.

Patent Document 1 suggests an art which increases production efficiency by increasing an elongation ratio of a seamless metal pipe in a mandrel mill. In the mandrel mill disclosed in Patent Document 1, roll diameters of first and second stands are set to be larger than a predetermined value. Accordingly, the elongation ratio of the seamless metal pipe can be increased.

CITATION LIST

Patent Document

[Patent Document 1] Japanese Unexamined Patent Application, First Publication No. 2008-296250

SUMMARY OF THE INVENTION

However, production efficiency is also dependent on rolling schedules of a piercing mill and a mandrel mill. Specifically, if the frequency for exchanging an inclined roll of the piercing mill and a roll (stand) of the mandrel mill according to the steel grade and the size of the manufactured seamless metal pipe is increased, an operating ratio of a manufacturing line is decreased. Due to the decrease in the operating ratio of the manufacturing line, the production efficiency is decreased.

Problems to be Solved by the Invention

An object of the present invention is to provide a manufacturing method and a manufacturing apparatus of a seamless metal pipe capable of increasing production efficiency by increasing the operating ratio of a manufacturing line.

Means for Solving the Problem

In order to solve the above-described problems, the present invention adopts the following measures.

(1) According to a first aspect of the present invention, a manufacturing method of a seamless metal pipe which manufactures a seamless metal pipe from a hollow shell using a mandrel mill having a preceding-stage stand group including a plurality of stands arranged from a head along a pass line and a succeeding-stage stand group including a plurality of stands arranged behind the preceding-stage stand group, the manufacturing method includes: inserting a mandrel bar into the hollow shell; determining whether the preceding-stage stand group is used in outer diameter reduction or in thickness reduction of the hollow shell; and performing elongating on the hollow shell, into which the mandrel bar is inserted, based on the determination, wherein in the elongating, when the preceding-stage stand group is used in the outer diameter reduction, the hollow shell is rolled in a state where an inner surface of the hollow shell does not come into contact with the mandrel bar in the preceding-stage stand group, and the hollow shell is rolled in a state where the inner surface of the hollow shell comes into contact with the mandrel bar in the succeeding-stage stand group, and wherein in the elongating, when the preceding-stage stand group is used in the thickness reduction, the hollow shell is rolled in the state where the inner surface of the hollow shell comes into contact with the mandrel bar in both the preceding-stage stand group and the succeeding-stage stand group.

(2) In the aspect according to the above (1), the manufacturing method may further include determining the number of stands when the preceding-stage stand group is used in the outer diameter reduction, according to at least one of a steel grade of the seamless metal pipe and a size of the seamless metal pipe.

(3) According to a second aspect of the present invention, a manufacturing apparatus of a seamless metal pipe includes: a rolling mill body which includes a preceding-stage stand group including a plurality of stands arranged from a head along a pass line and a succeeding-stage stand group including a plurality of stands arranged behind the preceding-stage stand group; a setting unit which sets whether the preceding-stage stand group of the rolling mill body is used in outer diameter reduction or in thickness reduction of a hollow shell; and a retaining system which inserts a mandrel bar into the hollow shell, wherein when the preceding-stage stand group is set to be used in the outer diameter reduction by the setting unit, the preceding-stage stand group rolls the hollow shell in a state where an inner surface of the hollow shell does not come into contact with the mandrel bar, and the succeeding-stage stand group rolls the hollow shell in a state where the inner surface of the hollow shell comes into contact with the mandrel bar, and wherein when the preceding-stage stand group is set to be used in the thickness reduction by the setting unit, the preceding-stage stand group and the succeeding-stage stand group roll the hollow shell in the state where the inner surface of the hollow shell comes into contact with the mandrel bar.

Effects of the Invention

According to each aspect, it is possible to increase production efficiency of a seamless metal pipe by suppressing a decrease in the operating ratio of a manufacturing line.

EMBODIMENTS OF THE INVENTION

Figure 1:
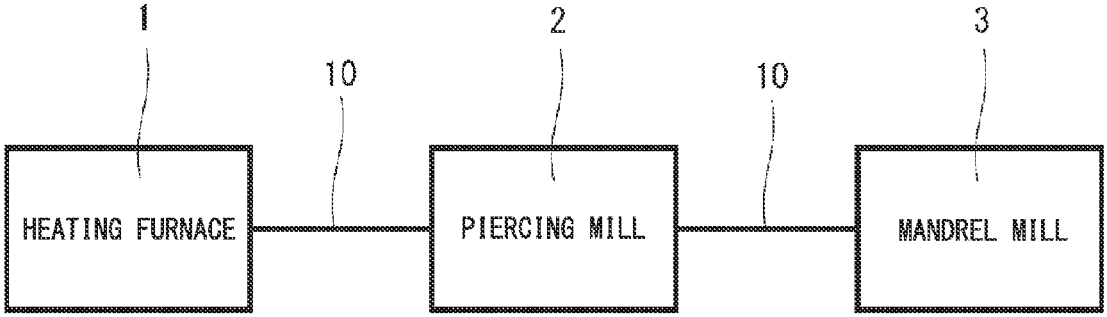
FIG. 1 is a function block diagram showing a manufacturing equipment of a seamless metal pipe.

Hereinafter, embodiments of the present invention will be described in detail with reference to the drawings. The same reference numerals are assigned to the same portions or the corresponding portions in the drawings and descriptions thereof are not repeated here.

Manufacturing Equipment of Seamless Metal Pipe

FIG. 1 is a block diagram showing an outline of manufacturing equipment of a seamless metal pipe. In the manufacturing equipment of a seamless metal pipe, the seamless metal pipe is manufactured by a so-called Mannesmann mandrel mill method. With reference to FIG. 1, the manufacturing equipment of the present embodiment includes a heating furnace 1, a piercing mill 2, and a mandrel mill 3. Each transport device 10 is disposed among the heating furnace 1, the piercing mill 2, and the mandrel mill 3. For example, each transport device 10 includes a plurality of transport rollers and transports a round billet or a hollow shell.

Heating Furnace 1 and Piercing Mill 2

Figure 2:
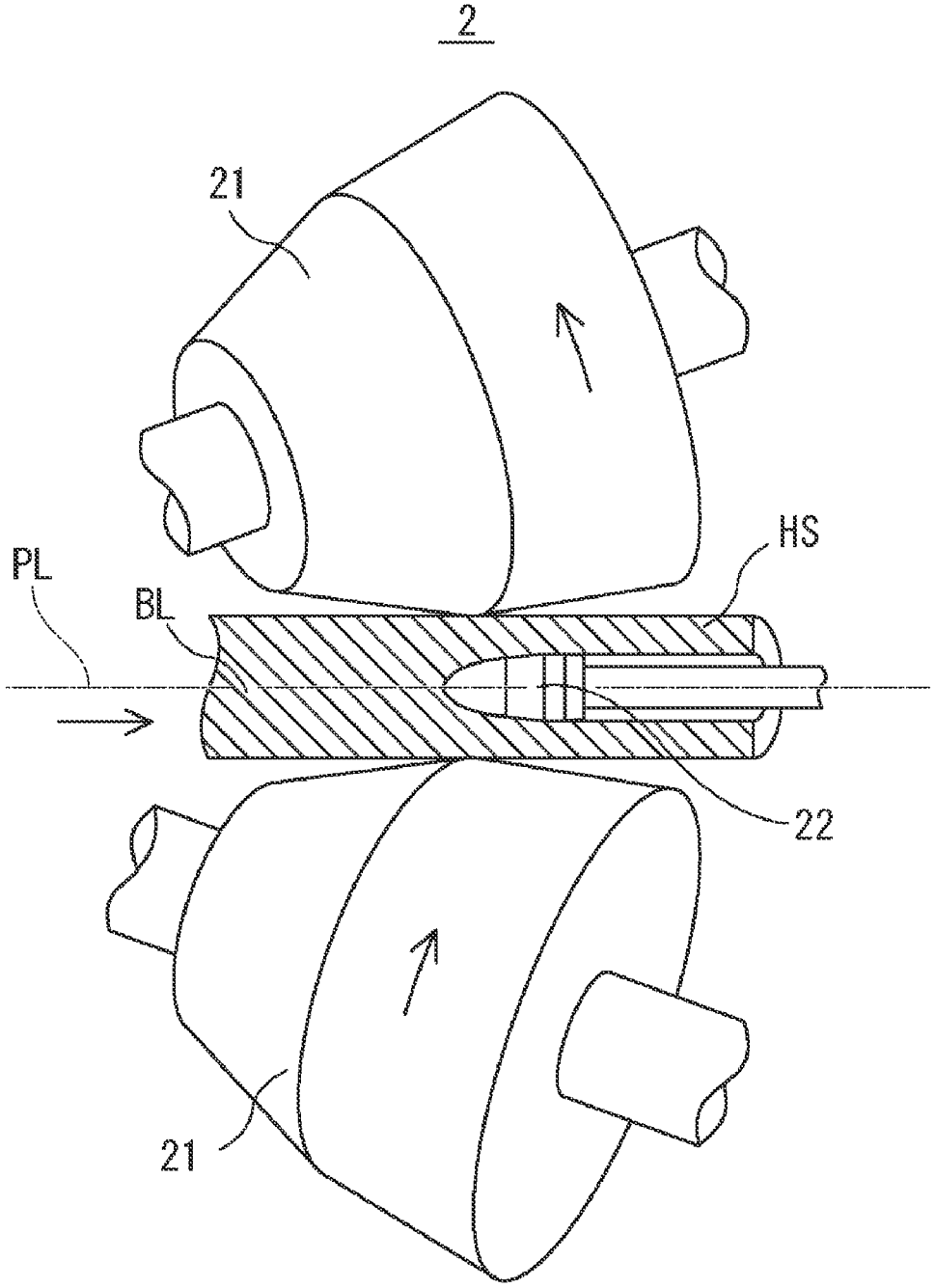
FIG. 2 is a schematic diagram showing a main portion of a piercing mill in FIG. 1.

The heating furnace 1 accommodates a solid round billet which is a material of the seamless metal pipe, and heats the billet. As shown in FIG. 2, the piercing mill 2 includes a pair of inclined rolls 21, and a plug 22. The plug 22 is disposed between the pair of inclined rolls 21 and on a pass line (rolling axis) PL. In the piercing mill 2, by both inclined rolls 21, a round billet BL interposed between both inclined rolls 21 is pushed into the plug 22 while being rotated around the circumferential direction, the round billet BL is pierced, and a hollow shell HS is manufactured.

Mandrel Mill 3

In the mandrel mill 3, a mandrel bar is inserted into the hollow shell HS, and the hollow shell HS into which the mandrel bar is inserted is elongated by a rolling mill body. After the mandrel bar is extracted from the hollow shell HS which is elongated by the mandrel mill 3, the hollow shell is transported to a reduction mill (not shown). For example, the reduction mill is a sizing mill or a stretch reducing mill. The reduction mill performs reduction rolling on the hollow shell HS and manufactures the seamless metal pipe.

Figure 3:
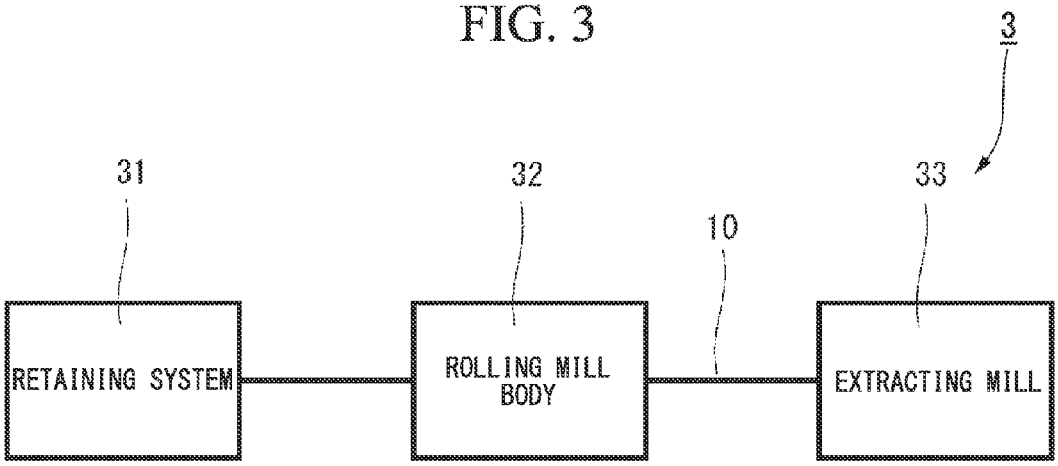
FIG. 3 is a function block diagram showing a mandrel mill in FIG. 1.

FIG. 3 is a block diagram showing a configuration of the mandrel mill 3. With reference to FIG. 3, the mandrel mill 3 includes a retaining system 31, a rolling mill body 32, and an extracting mill 33. The retaining system 31, the rolling mill body 32, and the extracting mill 33 are arranged in a line. The retaining system 31 inserts the mandrel bar into the hollow shell HS before the rolling mill body 32 performs the elongating on the hollow shell HS, or extracts the mandrel bar from the hollow shell HS after the elongating. The rolling mill body 32 performs the elongating on the hollow shell HS. The extracting mill 33 is used for extracting the mandrel bar from the hollow shell HS after the elongating. Hereinafter, each facility will be described in detail.

Rolling Mill Body 32

Figure 4:
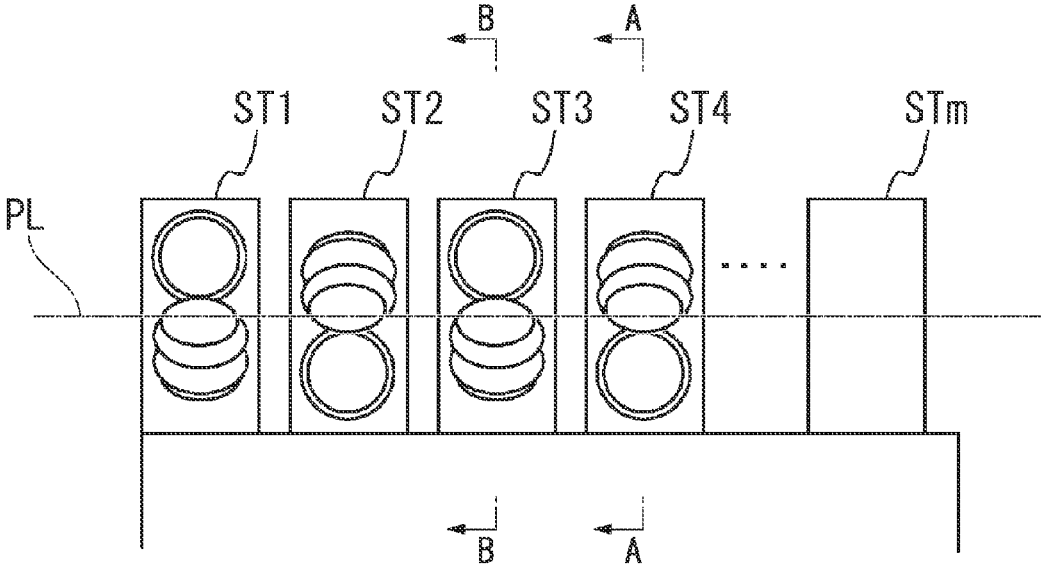
FIG. 4 is a side diagram of a rolling mill body of the mandrel mill in FIG. 3.

FIG. 4 is a side diagram of the rolling mill body 32 of the mandrel mill 3. With reference to FIG. 4, the rolling mill body 32 includes a plurality of stands ST1 to STm (m is a natural number) which are arranged in a line along the pass line PL. The total number m of the stands is not particularly limited. For example, the total number m of the stands is 4 to 8.

Figure 5:
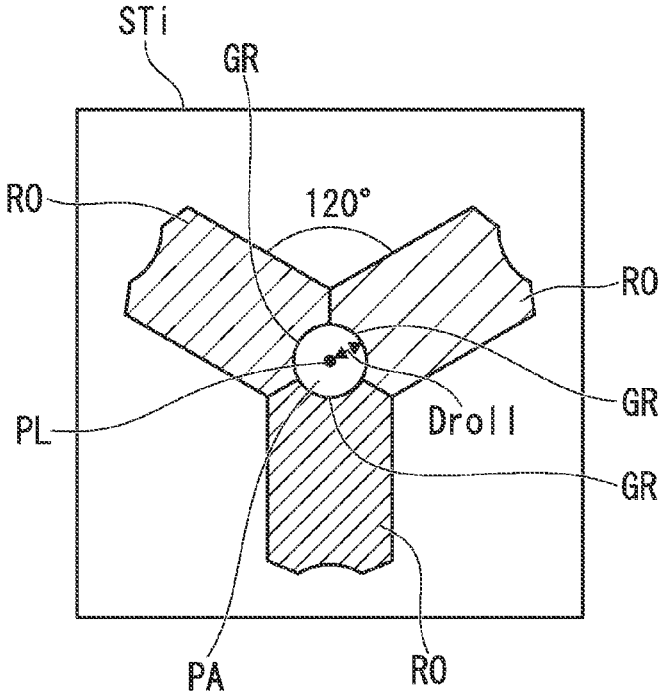
FIG. 5 is a front diagram of a stand in FIG. 4, and is a cross-sectional diagram taken along line A-A of FIG. 4.
Figure 6:
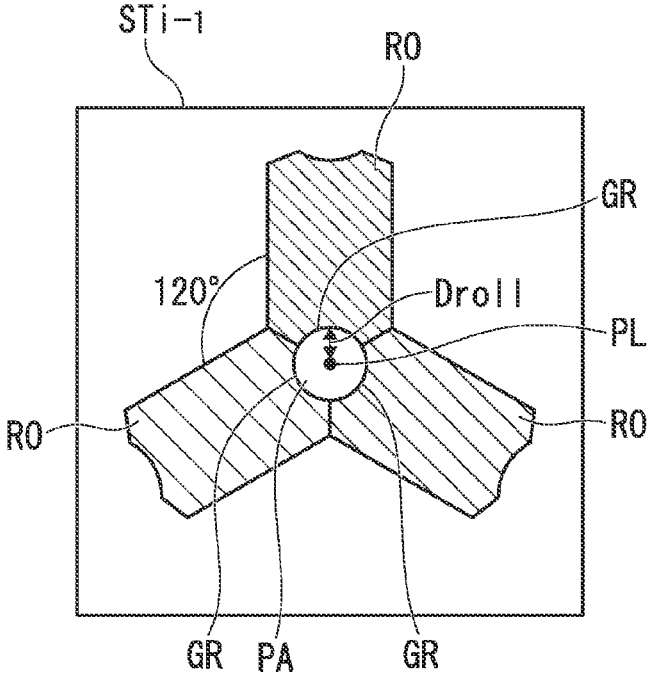
FIG. 6 is a front diagram of a stand different from FIG. 5, and is a cross-sectional diagram taken along line B-B of FIG. 4.

FIGS. 5 and 6 are cross-sectional diagrams of a stand STi (i=2 to m) and a stand STi−1. With reference to FIGS. 5 and 6, in the present example, each of the stands ST1 to STm includes three rolls RO which are disposed at positions of 120° to one another around the pass line PL. Each roll RO includes a groove GR in which a cross-sectional shape is formed in an arcuate shape when viewed from the cross-section including the central axis, and a hole die PA is formed by the grooves GR of three rolls RO.

As shown in FIGS. 5 and 6, when viewed along the pass line PL, three rolls RO included in the succeeding-stage stand STi (i=2 to m) are disposed to be deviated by 60° around the pass line PL from three rolls RO included in the preceding-stage stand STi−1.

Three rolls RO of each of the stands ST1 to STm are driven to be rotated by three motors (not shown).

In the cross-sectional area of the hole die PA formed of three rolls RO in each stand ST, the cross-sectional area of the hole die of the succeeding-stage stand is smaller than that of the preceding-stage stand.

Figure 7:
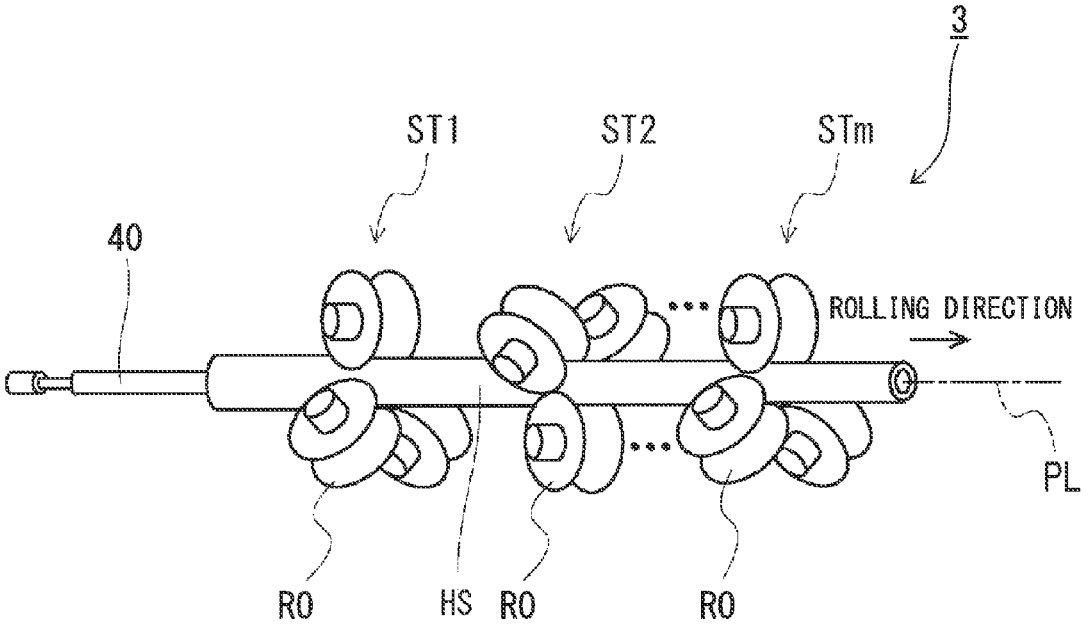
FIG. 7 is a schematic diagram showing elongating of a hollow shell by the mandrel mill.

As shown in FIG. 7, the hollow shell HS into which the mandrel bar 40 is inserted, is elongated through the stand ST1 to STm along the pass line PL, and outer diameter processing and thickness processing are performed on the hollow shell.

In the rolling mill body 32 shown in FIGS. 4 to 7, each stand STi includes three rolls RO. However, the number of rolls is not limited to three. The number of rolls of each stand STi may be two or four. The stand STi includes n (n is a natural number of two or more) rolls disposed around the pass line PL, and the n rolls of the succeeding stage are disposed to be deviated by 180°/n around the pass line PL from n rolls included in the stand STi−1 of the preceding stage.

Retaining System 31

Figure 8:
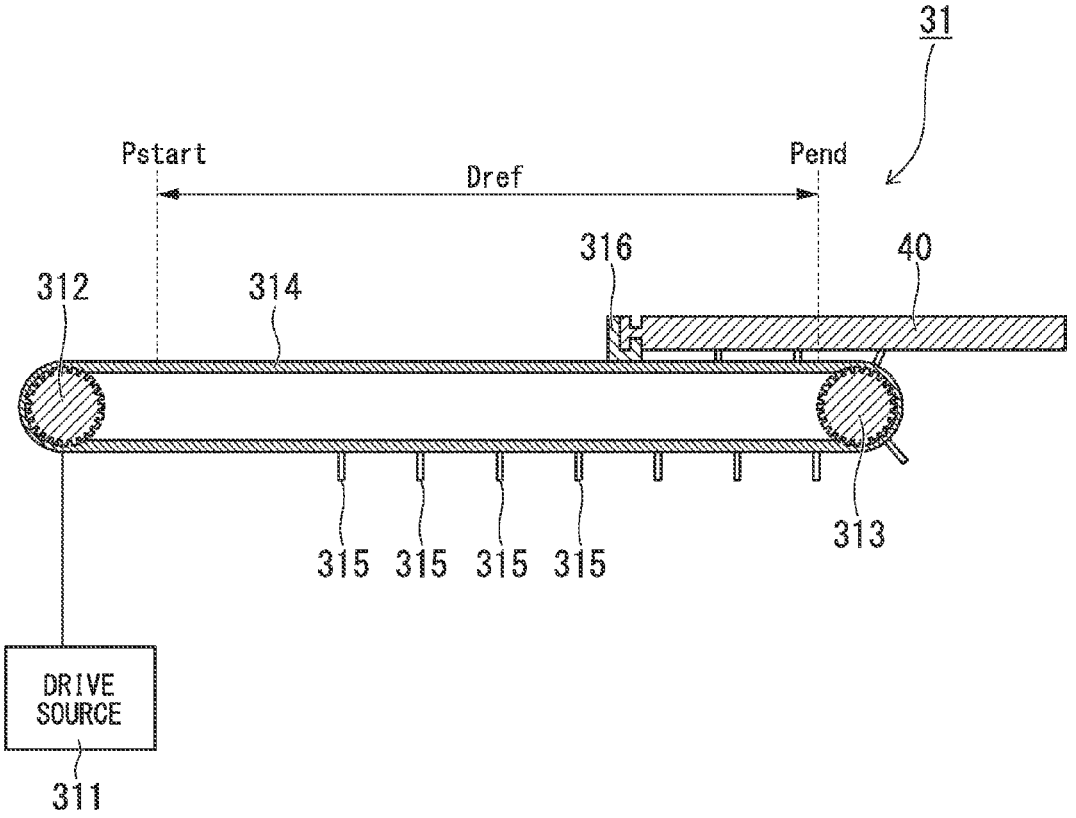
FIG. 8 is a vertical cross-sectional diagram of a retaining system in FIG. 3.

FIG. 8 is a vertical cross-sectional diagram of the retaining system 31. The retaining system 31 moves the mandrel bar 40 forward while holding the rear end of the mandrel bar 40, and inserts the mandrel bar 40 into the hollow shell HS. In addition, the retaining system 31 moves the hollow shell HS, into which the mandrel bar 40 is inserted, forward along the pass line PL during the elongating.

With reference to FIG. 8, the retaining system 31 includes a drive source 311 including a motor and a reducing gear, a drive wheel 312, a driven wheel 313, a chain 314, a plurality of support members 315, and a holding member 316.

The drive source 311 rotates the drive wheel 312 in a forward direction (clockwise direction in FIG. 8) and a backward direction (counterclockwise direction in FIG. 8). The driven wheel 313 is disposed to be apart from the drive wheel 312 at the front side of the drive wheel 312. The chain 314 is suspended over the drive wheel 312 and the driven wheel 313, and forms an endless track. The drive source 311, the drive wheel 312, the driven wheel 313, and the chain 314 configure a drive device which moves the mandrel bar 40 forward or rearward by a reference distance Dref.

Figure 9:
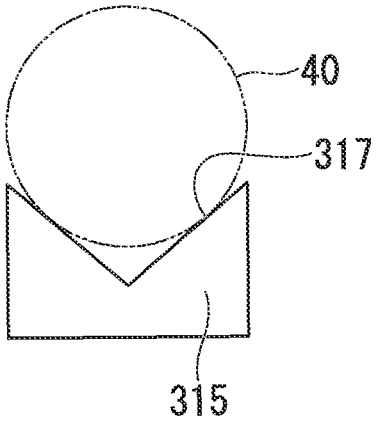
FIG. 9 is a front diagram of a support member in FIG. 8.

The plurality of support members 315 are arranged on the outer surface of the chain 314 in a line. FIG. 9 is a front diagram of the support member 315. In addition, a two-dot chain line in FIG. 9 indicates the mandrel bar 40. The support member 315 includes an inverted triangular groove 317. A width of the groove 317 is gradually decreased from the upper end of the support member 315 toward the lower end. The plurality of support members 315 support the mandrel bar 40 so that the axis of the mandrel bar 40 continuously coincides with the pass line PL while the retaining system 31 moves the mandrel bar 40 forward.

Figure 10A:
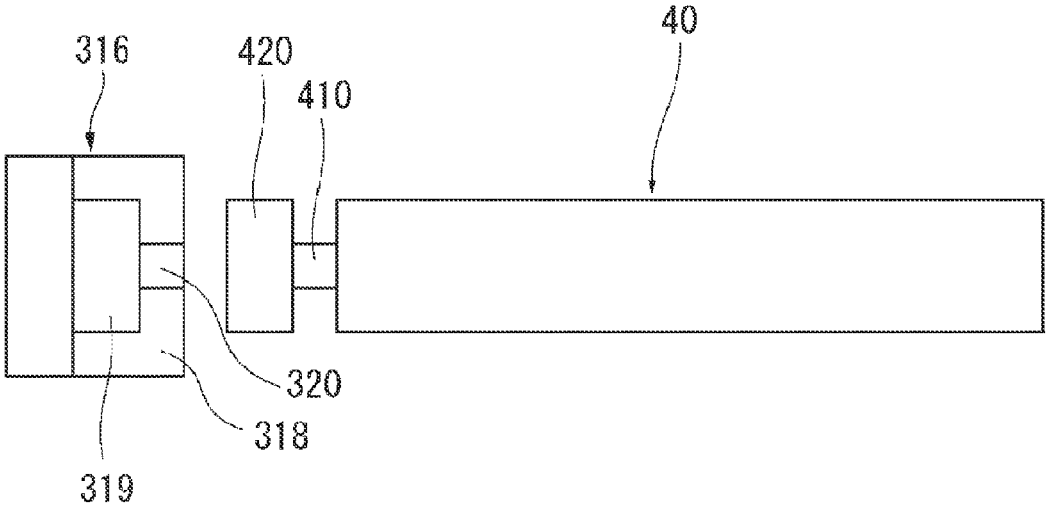
FIG. 10A is a plan diagram of a holding member and a mandrel bar of the retaining system.
Figure 10B:
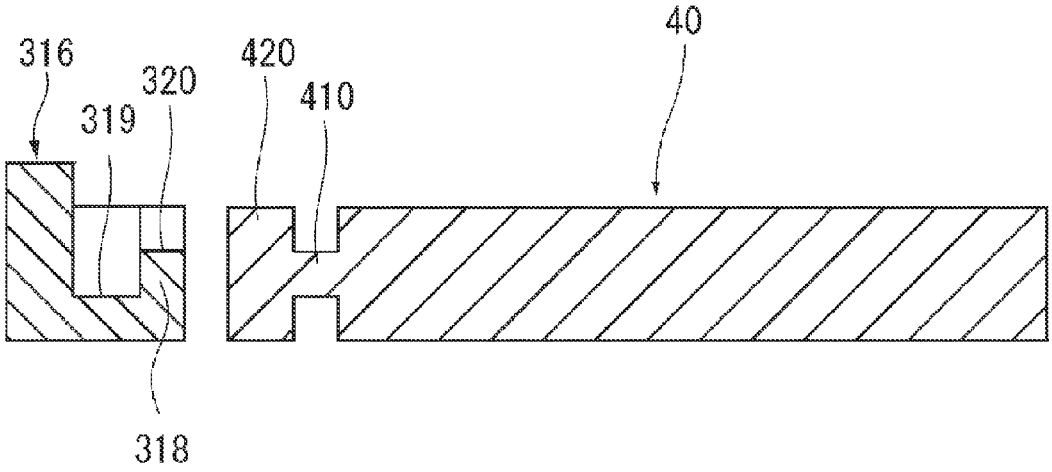
FIG. 10B is a vertical cross-sectional diagram of the holding member and the mandrel bar shown in FIG. 10A.
Figure 10C:
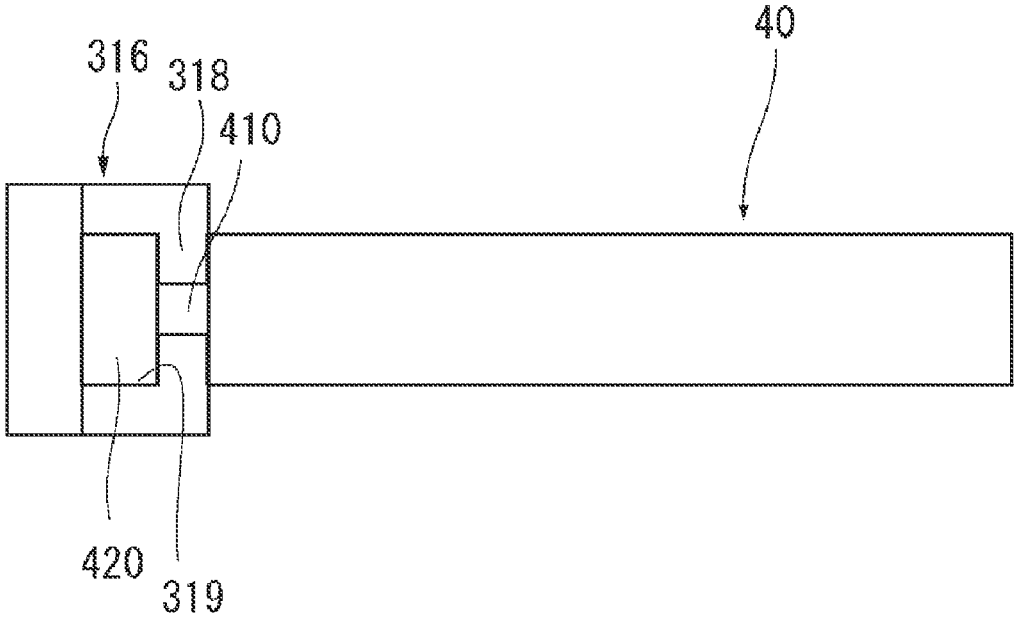
FIG. 10C is a plan diagram showing a state where the mandrel bar is mounted on the holding member of FIG. 10A.
Figure 10D:
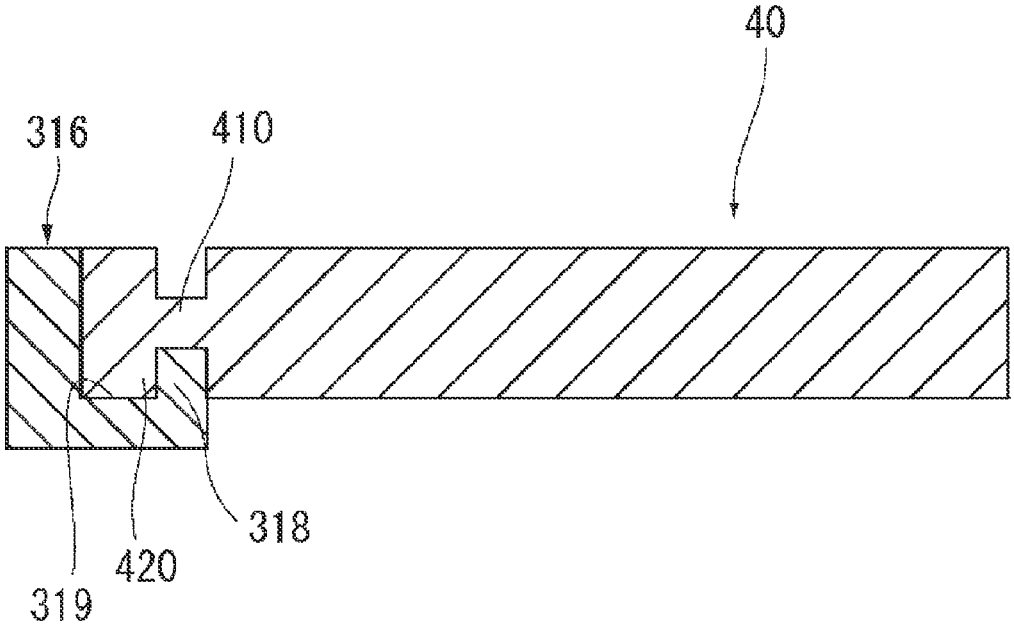
FIG. 10D is a vertical cross-sectional diagram of the holding member and the mandrel bar shown in FIG. 10C.

FIGS. 10A and 10B are a plan diagram and a vertical cross-sectional diagram of the holding member 316 and the mandrel bar 40. FIGS. 10C and 10D are a plan diagram and a vertical cross-sectional diagram of the holding member 316 which holds the rear end of the mandrel bar 40.

With reference to FIGS. 8, 10A, and 10B, the holding member 316 is fixed onto the upper surface of the chain 314. The holding member 316 moves forward or rearward (refer to FIG. 8) by the reference distance Dref (between a start position Pstart and an end position Pend) by operating (rotating) the chain 314.

With reference to FIGS. 10A and 10B, the holding member 316 includes a groove 319 and a hook 318. The groove 319 is formed on the upper surface of the holding member 316 and extends to be perpendicular to an axial direction of the mandrel bar 40. The hook 318 is formed further forward than the groove 319, and includes an upward convex shape.

The mandrel bar 40 has a rod shape, and a cross-section shape perpendicular to the axis is a circle. The mandrel bar 40 includes a neck 410 and a flange 420 at the rear end. The neck 410 has a rod shape in which the cross section perpendicular to the axis is a circle, and an outer diameter of the neck 410 is smaller than an outer diameter of a main body portion of the mandrel bar 40. The flange 420 is disposed at the rear end of the neck 410. The flange 420 is formed in a disk shape, and has a larger outer diameter than that of the neck 410.

A width of the groove 319 is approximately the same as or slight larger than a width of the flange 420. In addition, a bottom surface of the groove 319 is curved to be concave in an arc shape. A concave portion 320 to which the neck 410 is fitted is formed on the upper surface of the hook 318.

As shown in FIGS. 10C and 10D, the flange 420 is fitted to the groove 319 of the holding member 316. Accordingly, the holding member 316 holds the mandrel bar 40. The holding member 316 moves forward by the reference distance Dref shown in FIG. 8 while holding the rear end (neck 410 and flange 420) of the mandrel bar 40 disposed in the hollow shell HS during the elongating by the rolling mill body 32. At this time, the drive device (the drive source 311, the drive wheel 312, the driven wheel 313, and the chain 314) of the retaining system 31 moves the holding member 316 forward by the reference distance Dref. In this way, the retaining system 31 controls a forward speed of the mandrel bar 40 during the elongating by the rolling mill body 32. In addition, the retaining system 31 inserts the mandrel bar 40 into the hollow shell HS before the elongating is performed. Moreover, the retaining system 31 moves the holding member 316 rearward after the elongating is performed, and extracts the mandrel bar 40 from the elongated hollow shell HS.

The retaining system 31 moves the holding member 316 forward or rearward by the drive device which forms an endless track by the chain 314. However, the drive device of the retaining system 31 may include other configurations. For example, the drive device of the retaining system 31 may include a rack and pinion, and thus, move the holding member 316 forward or rearward. In addition, the drive device may include an electric or hydraulic cylinder, mount the holding member 316 on the tip of the cylinder, and thus, move the holding member 316 forward or rearward.

Extracting Mill 33

Figure 11:
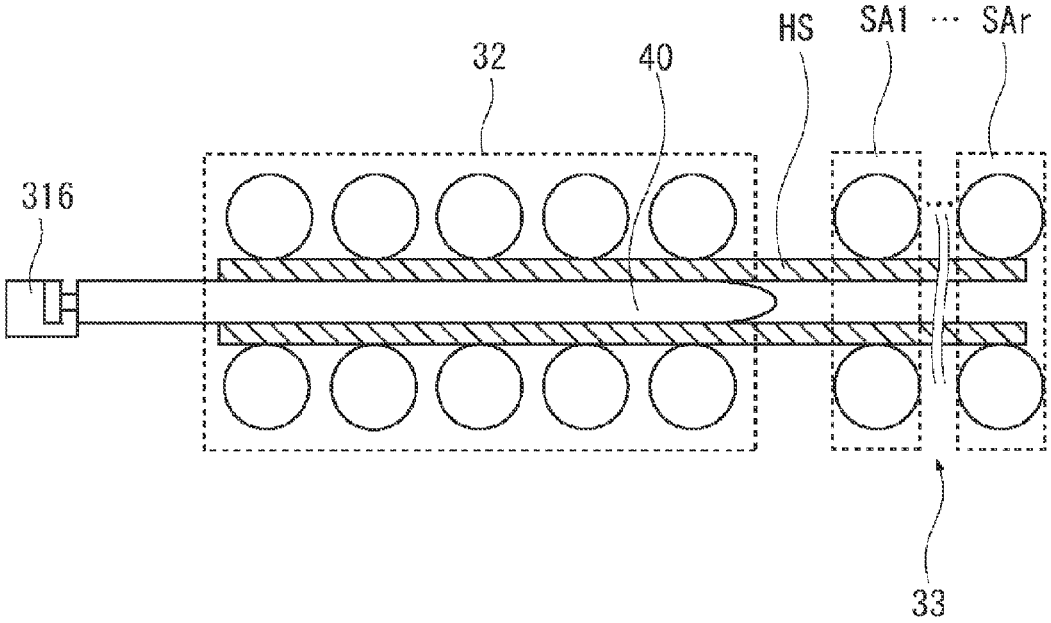
FIG. 11 is a schematic diagram of the rolling mill body shown in FIG. 3 and an extracting mill.

With reference to FIG. 11, the extracting mill 33 includes a plurality of stands SA1 to SAr (r is a natural number) which are arranged in a line along the pass line PL. Each of the stands SA1 to SAr includes a plurality of rolls which are disposed at equal intervals around the pass line PL. The number of the rolls in each of the stands SA1 to SAn may be two, three, or four. For example, the total number r of the stands of the extracting mill 33 is 2 to 4.

The extracting mill 33 bites the tip portion of the hollow shell HS and performs slight reduction rolling on the tip portion when the hollow shell HS is elongated by the rolling mill body 32. When the tip portion of the hollow shell HS is reduction-rolled by the extracting mill 33, the retaining system 31 reversely rotates the drive wheel 312 and moves the holding member 316 rearward. Accordingly, the mandrel bar 40 is extracted from the hollow shell HS to the rear side. In brief, the extracting mill 33 is equipment for extracting the mandrel bar 40.

In the present embodiment, the extracting mill 33 is used to extract the mandrel bar 40. However, instead of the extracting mill 33, a reduction mill such as a sizing mill or a stretch reducing mill may be disposed. Similar to the extracting mill 33, the reduction mill also performs the reduction rolling on the hollow shell. Accordingly, similar to the case where the extracting mill 33 is used, the mandrel bar 40 can be extracted from the hollow shell HS.

Manufacturing Process of Seamless Metal Pipe

In a manufacturing method of a seamless metal pipe according to the present embodiment, the number of the stands used for thickness reduction in the rolling mill body 32 of the mandrel mill 3 is changed according to the steel grade of the seamless metal pipe and the elongation ratio of the seamless metal pipe.

Figure 12:
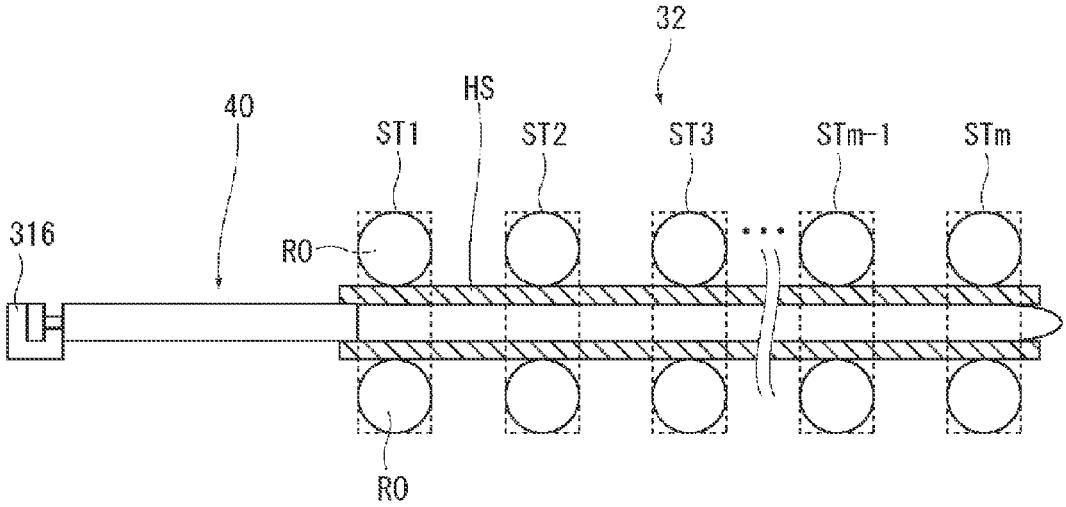
FIG. 12 is a schematic diagram showing "entire thickness reduction" in the mandrel mill.

For example, when a hollow shell formed of a steel grade having a high rolling force such as high alloy is elongated, or when the elongation ratio of the seamless metal pipe is high, as shown in FIG. 12, the thickness reduction is performed by all stands ST1 to STm of the mandrel mill 3. Here, the "thickness reduction" means that the hollow shell HS is reduced while the inner surface of the hollow shell HS comes into contact with the outer surface of the mandrel bar 40 when the hollow shell HS comes into contact with the rolls RO in the stand STi and is reduced. In this case, the hollow shell HS is interposed between the rolls RO and the mandrel bar 40 and is elongated, and thus, the thickness of the hollow shell is changed. Since the thickness reduction is performed by all stands ST1 to STm, this case is adopted when a seamless metal pipe having a high rolling force is manufactured and when a seamless metal pipe having a high elongation ratio is manufactured. Hereinafter, the elongating shown in FIG. 12 is referred to as "entire thickness reduction".

Figure 13:
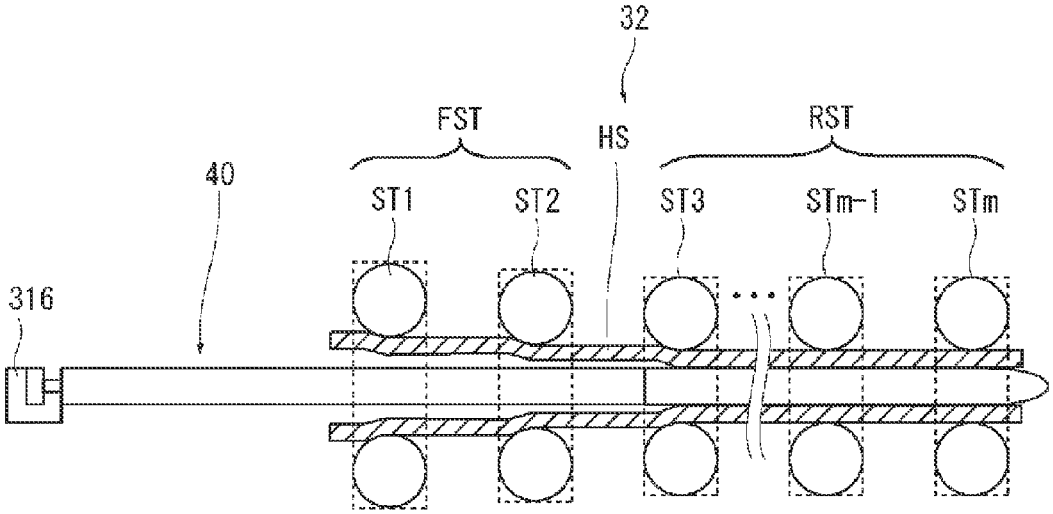
FIG. 13 is a schematic diagram showing "partial outer diameter reduction" in the mandrel mill.

On the other hand, when a hollow shell formed of a steel grade having a low rolling force such as common steel is elongated, or when the elongation ratio of a seamless metal pipe is low, among the stands ST1 to STm of the mandrel mill 3, it is sufficient if a portion of the plurality of stands ST performs the thickness reduction. Accordingly, in this case, as shown in FIG. 13, instead of the thickness reduction, outer diameter reduction is performed in a stand group (hereinafter, referred to as a preceding-stage stand group FST) including the plurality of stands ST1 to STj (j is a natural number, j<m) which are continuously arranged from the head among the plurality of stands ST1 to STm. On the other hand, the thickness reduction is performed in a stand group (hereinafter, referred to a succeeding-stage stand group RST) including the stands STj+1 to STm. Here, the "outer diameter reduction" means that the hollow shell HS is reduced while the inner surface of the hollow shell HS does not come into contact with the outer surface of the mandrel bar 40 when the hollow shell HS comes into contact with the rolls RO in the stands STi (i=1 to j) and is reduced. In other words, in the preceding-stage stand group FST, reduction rolling is performed. Hereinafter, this elongating is referred to as "partial outer diameter reduction".

In the partial outer diameter reduction, the diameter of the hollow shell HS manufactured by the piercing mill 2 can be further decreased. Accordingly, for example, the outer diameter reduction is performed on the hollow shell which should be rolled to a predetermined outer diameter by the piercing mill 2 in the related art, by the preceding-stage stand group FST, and thus, a predetermined outer diameter can be achieved. Therefore, the outer diameter of the hollow shell which is to be finished by the piercing mill 2 can be larger than the related art. In this case, the frequency of exchanging the inclined roll 21 of the piercing mill 2 according to the outer diameter dimension of the hollow shell to be manufactured can be decreased. This is because the size which is to be reduced by the piercing mill 2 can be replaced by the preceding-stage stand group FST. Accordingly, by performing the partial outer diameter reduction, the frequency of exchanging the roll can be decreased, and the degree of freedom in rolling schedules of the piercing mill 2 and the mandrel mill 3 can be increased. In other words, in the manufacturing process of the seamless metal pipe of the present embodiment, the operation ratios of the piercing mill 2 and the mandrel mill 3 can be increased, and as a result, the production efficiency can be increased.

When the partial outer diameter reduction is performed, the outer diameter of the hollow shell HS manufactured by the piercing mill 2 can be more uniformly adjusted by the preceding-stage group FST. Accordingly, the dimensional accuracy of the seamless metal pipe can be further increased.

In the present embodiment, the stands ST1 to STm of the mandrel mill 3 are classified into the preceding-stage stand group FST and the succeeding-stage stand group RST as needed, and the "entire thickness reduction" or the "partial outer diameter reduction" is performed. Hereinafter, a manufacturing process will be described in detail.

Figure 14:
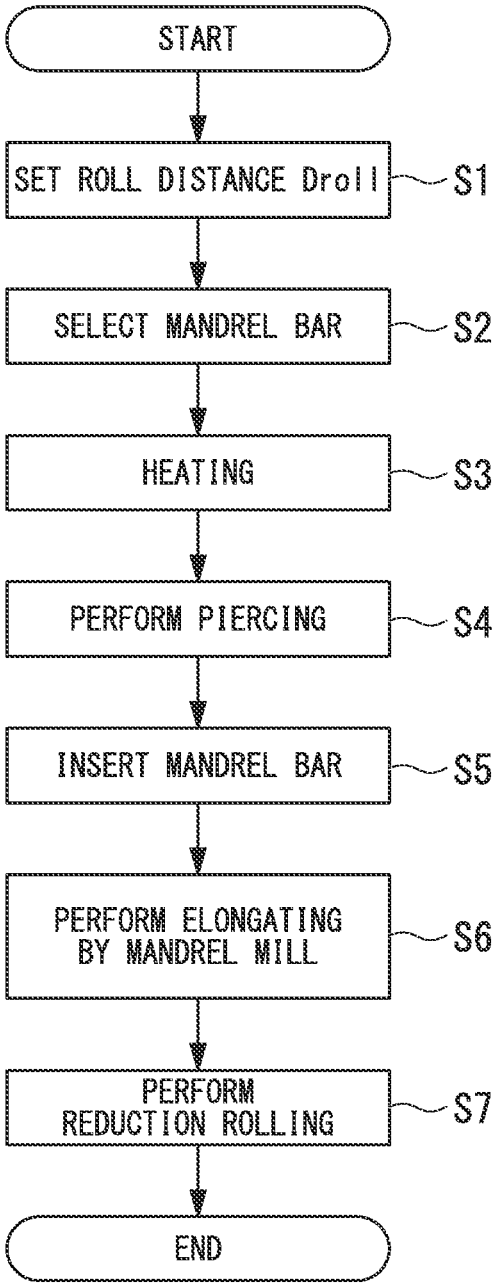
FIG. 14 is a flowchart showing a manufacturing process of a seamless metal pipe according to the present embodiment.

FIG. 14 is a flowchart of the manufacturing method of the seamless metal pipe according to the present embodiment. With reference to FIG. 14, first, a roll distance Droll (a distance from the center of the pass line PL to the groove GR of the roll RO) of each of the stands ST1 to STm of the mandrel mill 3 is set according to the steel grade of a seamless metal pipe to be manufactured and the size of the seamless metal pipe (Step S1).

According to the setting of Step S1, it is determined whether or not the mandrel mill 3 performs the entire thickness reduction or the partial outer diameter reduction. In addition, according to the setting of Step S1, when the partial outer diameter reduction is performed, the stands ST1 to STj included in the preceding-stage stand group FST are determined. In brief, the total number j of the stands included in the preceding-stage stand group FST can be changed according to the setting of Step S1. For example, the total number j of the stands included in the preceding-stage stand group FST is determined based on the steel grade and/or the size (outer diameter and thickness) of the manufactured seamless metal pipe.

For example, the roll distance Droll of each stand STi is determined in advance in accordance with the steel grade and the size (outer diameter and thickness) of the manufactured seamless metal pipe. In addition, the roll distance Droll is in association with the steel grade and the size of the seamless metal pipe, and is recorded in a storage device (HDD or memory) of a computer (not shown). By reading the value of the roll distance Droll corresponding to the steel grade and the size of the manufactured seamless metal pipe from the computer, the roll distance Droll of each of the stands ST1 to STm is adjusted to the value of the roll distance Droll to be set.

In addition, the used mandrel bar is selected according to the size (outer diameter dimension and thickness dimension) of the seamless metal pipe to be manufactured (Step S2). In the present embodiment, a plurality of mandrel bars having outer diameters different from one another are prepared in advance according to the size of the seamless metal pipe. In Step S2, a mandrel bar having an appropriate outer diameter is selected among the mandrel bars.

Subsequently, a round billet is heated in the heating furnace 1 (Step S3). The round billet may be manufactured by continuous casting, or may be manufactured by rolling an ingot or a slab. The heated round billet is pierced by the piercing mill 2, and thus, the hollow shell HS is manufactured (Step S4).

Subsequently, the mandrel bar 40 selected in Step S2 is inserted into the hollow shell HS (Step S5). In the present embodiment, the retaining system 31 inserts the mandrel bar 40 into the hollow shell HS.

Subsequently, the hollow shell HS is elongated by the mandrel mill 3 (Step S6). The mandrel mill 3 performs the entire thickness reduction or the partial outer diameter reduction on the hollow shell HS according to the setting of the roll distance Droll in Step S1. After the elongating is performed by the mandrel mill 3, the hollow shell HS is reduction-rolled by the sizing mill or the stretch reducing mill, and thus, the seamless metal pipe is manufactured (Step S7).

According to the above-described processes, in the manufacturing method of the seamless metal pipe of the present embodiment, the entire thickness reduction or the partial outer diameter reduction is performed by the mandrel mill 3 according to the steel grade and the size of the manufactured seamless metal pipe. Accordingly, with respect to the seamless metal pipe formed of a steel grade having a high rolling force and the seamless metal pipe having a high elongation ratio, the entire thickness reduction is performed, and the rolling can be performed by the mandrel mill 3. In addition, with respect to the seamless metal pipe formed of a steel grade having a low rolling force and the seamless metal pipe having a low elongation ratio, the partial outer diameter reduction is performed, the frequency of the roll exchange in the piercing mill 2 and the rolling mill body 32 of the mandrel mill 3 is decreased, and the degree of freedom of the rolling schedule can be increased. Accordingly, the operating ratios of the piercing mill 2 and the mandrel mill 3 are increased, and the production efficiency can be increased.

The number of the stands in the mandrel mill, and a rolling capability (equipment capability) per stand are designed so that even a steel grade having a high rolling force such as high alloy is processed to a target thickness. Accordingly, when a steel grade having a low rolling force such as common steel is elongated, excess is generated in the rolling capability (equipment capability). That is, in a steel grade having a low rolling force, necessary rolling is performed by using only a portion of the stands, not all of the stands. According to the present embodiment, when a steel grade which does not require the use of all of the stands is elongated, the outer diameter reduction can be performed using the preceding-stage stand group FST which becomes surplus. Therefore, the diameter of the hollow shell HS manufactured by the piercing mill 2 can be further reduced by the preceding-stage stand group FST. Accordingly, as described above, the exchange frequency of the inclined roll 21 of the piercing mill 2 can be decreased.

Second Embodiment

As described above, the mandrel mill 3 performs the "entire thickness reduction" and the "partial outer diameter reduction". Accordingly, the number of the stands performing the thickness reduction in the rolling mill body 32 of the mandrel mill 3 is changed according to the steel grade and the size of the hollow shell HS. Therefore, the mandrel bar 40 may be selected according to the number of the stands performing the thickness reduction.

Figure 15:
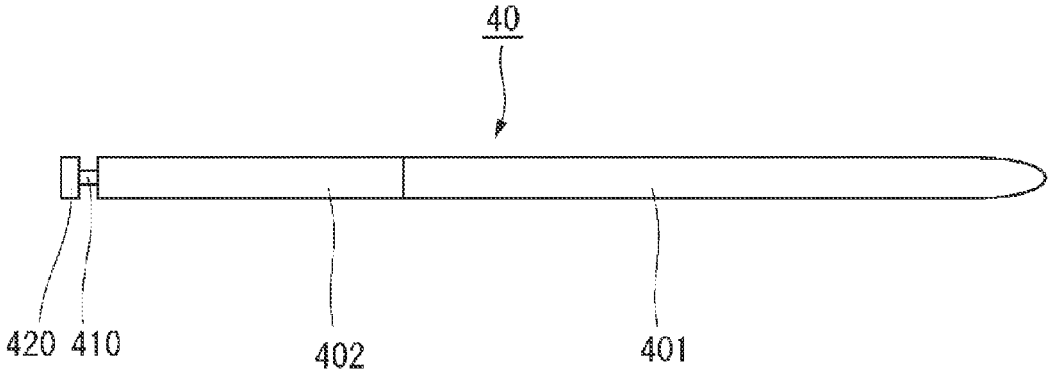
FIG. 15 is a side diagram of the mandrel bar.

FIG. 15 is a side diagram of the mandrel bar 40. With reference to FIG. 15, the mandrel bar 40 includes a work portion 401 and an extension portion 402. The work portion 401 and the extension portion 402 are manufactured of a separate material, and are connected to be coaxial with each other. For example, threading is performed on the rear end of the work portion 401 and the front end of the extension portion 402, the rear end and the front end are fastened, and thus, the work portion and the extension portion are connected to each other.

The work portion 401 is disposed on the front portion of the mandrel bar 40. The work portion 401 comes into contact with the inner surface of the hollow shell HS when the elongating is performed. That is, the work portion 401 is a portion which is used for the thickness reduction in the mandrel bar 40. Since the work portion 401 easily receives heat from the hollow shell HS and easily receives compressive stress in the thickness direction and tensile stress in the axial direction, wear and crack easily occur in the work portion 401. Therefore, an expensive material having improved high temperature strength, heat crack resistance, and wear resistance represented by an alloy tool steel (SKD) of JIS standard is used for the work portion 401. In addition, the accuracy in the thickness of the seamless metal pipe is dependent on the shape (outer diameter accuracy) of the work portion 401, and cleanliness of the inner surface of the seamless metal pipe is dependent on the cleanliness of the outer surface of the work portion 401. Accordingly, the work portion 401 requires a material having improved mechanical characteristics, high outer diameter accuracy, and high outer surface cleanliness. Accordingly, the manufacturing cost of the work portion 401 is high.

The extension portion 402 is mounted on the rear end of the work portion 401 to be coaxial with the work portion 401. The neck 410 and the flange 420 are formed on the rear end of the extension portion 402. The extension portion 402 does not come into contact with the inner surface of the hollow shell HS during the elongating. Accordingly, compared to the work portion 401, the extension portion 402 does not require high mechanical characteristics (strength, heat crack resistance, and wear resistance), outer diameter accuracy, and outer surface cleanliness. Accordingly, the extension portion 402 can use a cheaper material than the work portion 401, and thus, the manufacturing cost can be suppressed. In addition, the outer diameter of the extension portion 402 may be smaller than the outer diameter of the work portion 401, and in this case, the manufacturing cost can be further suppressed.

As described above, in the mandrel mill 3, either the entire thickness reduction or the partial outer diameter reduction is performed. In the case of the partial outer diameter reduction, the number j of the stands included in the preceding-stage stand group FST may be different according to the steel grade and the size of the manufactured seamless metal pipe. That is, in the mandrel mill 3, the total number of the stands ST performing the thickness reduction may be different according to the steel grade and the size of the seamless metal pipe.

Accordingly, in the present embodiment, the plurality of mandrel bars 40 including the work portions 401 having different lengths are prepared according to the number of the stands performing the thickness reduction. As described above, in Step S2 of FIG. 14, when the mandrel bar 40 is selected, a plurality of kinds of mandrel bars 40 having outer diameters according to the size of the manufactured seamless metal pipe are selected.

Here, the number of the stands performing the thickness reduction is determined by the setting of the roll distance Droll of Step S1. Accordingly, among the selected plurality of kinds of mandrel bars 40, the mandrel bar 40 including the work portion 401 having the length corresponding to the number of the stands performing the thickness reduction is determined as the used mandrel bar 40 (Step S2).

Figure 16:
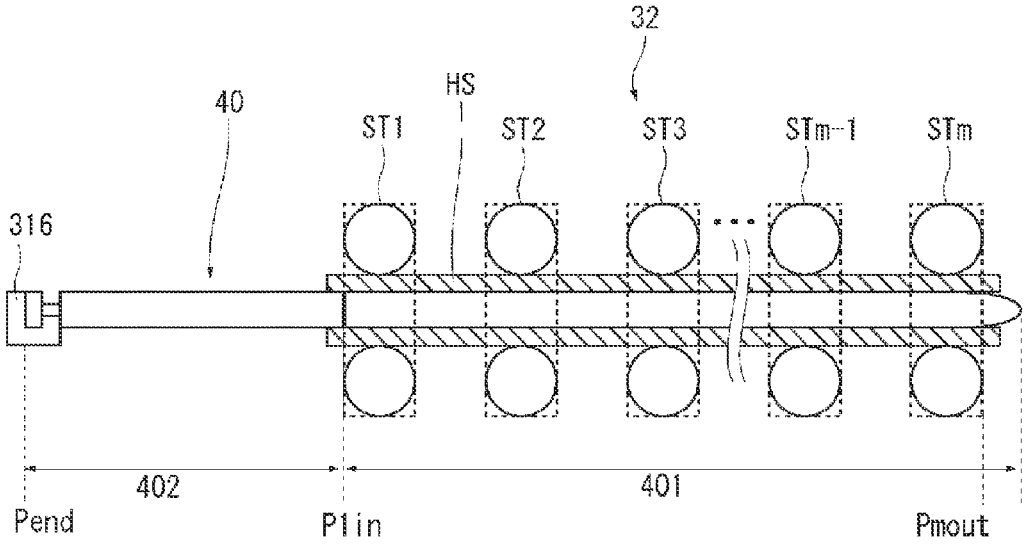
FIG. 16 is a schematic diagram showing the state of the mandrel bar during the entire thickness reduction.

For example, as shown in FIG. 16, when the holding member 316 of the retaining system 31 moves forward to the end position Pend on the chain 314 in the case where the entire thickness reduction is performed, the mandrel bar 40 including the work portion 401 having at least the same length as a distance from an inlet position P1in of the head stand ST1 of the rolling mill body 32 to an outlet position Pmout of the final stand STm is selected. In this case, the thickness reduction can be performed using the work portion 401 in each of the stands ST1 to STm. In addition, in this case, the extension portion 402 may have at least the same length as a distance from the end position Pend to the inlet position P1in.

Figure 17:
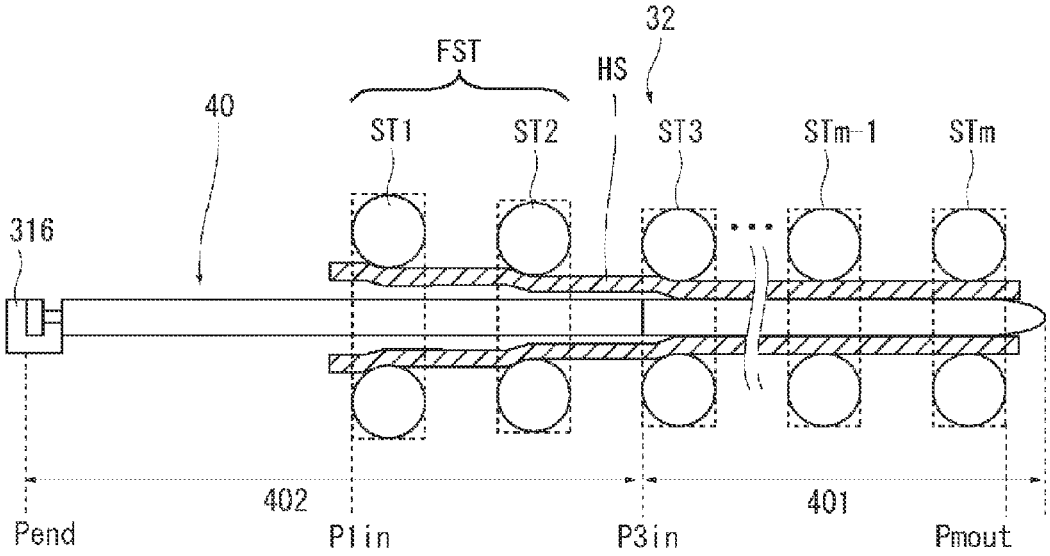
FIG. 17 is a schematic diagram showing the state of the mandrel bar during the partial outer diameter reduction.

On the other hand, as shown in FIG. 17, when the partial outer diameter reduction is performed and stands ST1 and ST2 correspond to the preceding-stage stand group FST, the thickness reduction is performed in the stands ST3 to STm. Accordingly, the work portion 401 may have at least the same length as a distance from an inlet position P3in of the stand ST3 to the outlet position Pmout of the final stand STm. Moreover, the extension portion 402 may have at least the same length as a distance from the end position Pend to the inlet position P3in of the third stand ST3.

The work portion 401 when the partial outer diameter reduction is performed may be shorter than the work portion 401 when the entire thickness reduction is performed. This is because the number of the stands by which the thickness reduction is performed in the partial outer diameter reduction is smaller than the number of the stands by which the thickness reduction is performed in the entire thickness reduction. In addition, also understood from FIG. 17, in the partial outer diameter reduction, the work portion 401 of the mandrel bar 40 can be shortened as the number of the stands included in the preceding-stage stand group FST is increased.

As described above, in the present embodiment, the plurality of mandrel bars 40 including the work portions 401 having lengths different from one another are prepared in advance. The length of the work portion 401 of each mandrel bar 40 is determined in advance according to the number of the stands performing the thickness reduction. In addition, in Step S2 of the manufacturing process shown in FIG. 14, the mandrel bar 40 including the work portion 401 having the length corresponding to the number of the stands by which the thickness reduction is performed is selected.

The plurality of (for example, 10 to 20) mandrel bars 40 are used every time one lot of seamless metal pipe having a specific steel grade and a specific size is manufactured. Accordingly, if the plurality of steel grades and sizes in the manufactured seamless metal pipe are present, a stock quantity of the mandrel bars 40 required for the elongating is significantly increased. In the present embodiment, the length of the work portion 401 of the mandrel bar 40 used in the partial outer diameter reduction can be shorter than that of the case of the entire thickness reduction. Since the work portion 401 can use the shorter mandrel bar, the total manufacturing costs of the mandrel bars 40 required for stocking can be suppressed.

In the present embodiment, the partial outer diameter reduction is performed in the preceding-stage stand group FST. Accordingly, the mandrel bars 40 having the work portions 401 having lengths different from one another are included in the prepared plurality of mandrel bars 40. However, the total lengths of the plurality of mandrel bars 40 are the same as one another. As shown in FIGS. 16 and 17, this is because the final stand STm performs the thickness reduction in both of the entire thickness reduction and the partial outer diameter reduction.

Third Embodiment

As described above, in the elongating by the mandrel mill 3, the plurality of mandrel bars 40 are prepared and stocked. The manufacturing cost of the mandrel bar 40 is increased as the mandrel bar 40 is lengthened. In addition, a wider stock space is required as the mandrel bar 40 is lengthened. It is preferable that the stock space be decreased if necessary.

Figure 18:
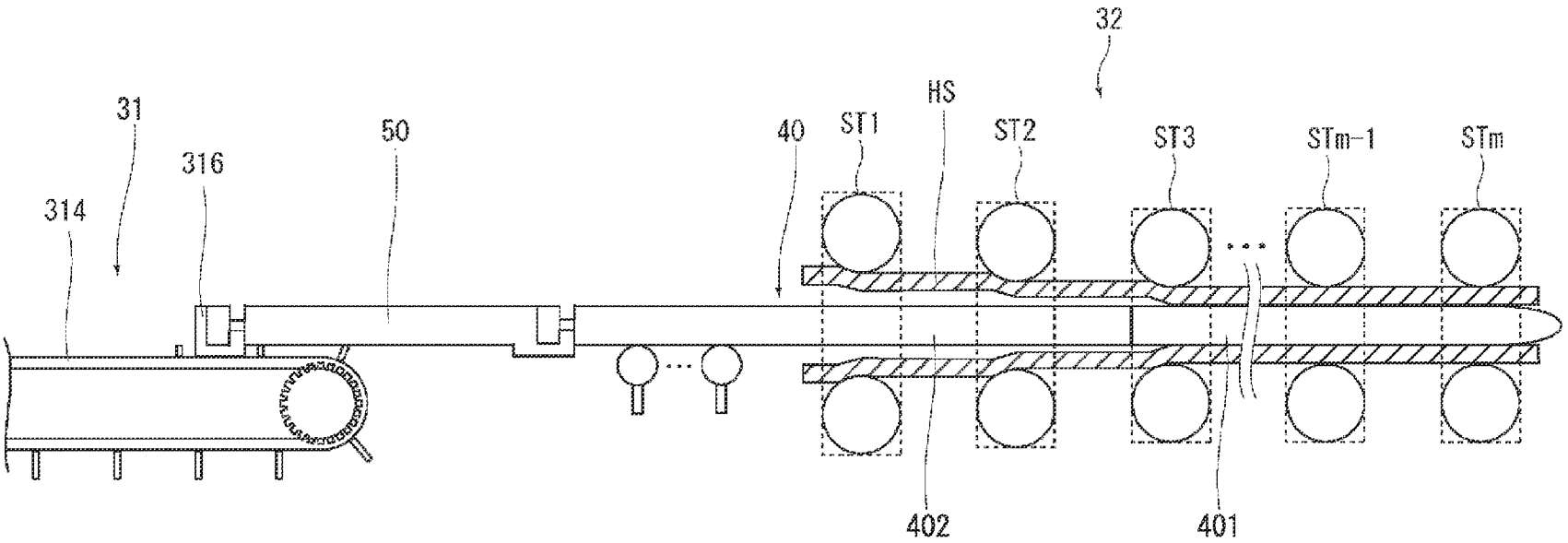
FIG. 18 is a schematic diagram showing the elongating in the mandrel mill when an auxiliary tool is used.

FIG. 18 is a vertical cross-sectional diagram of the mandrel mill 3 according to the present embodiment. With reference to FIG. 18, compared to the mandrel mill 3 of the first embodiment, the mandrel mill 3 further includes an auxiliary tool 50.

Auxiliary Tool 50

Figure 19:
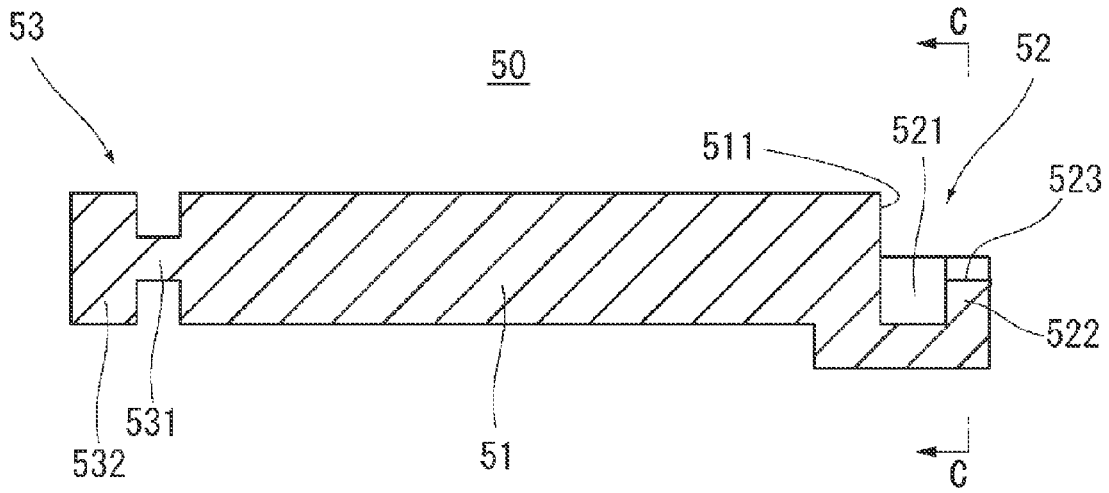
FIG. 19 is a vertical cross-sectional diagram of the auxiliary tool in FIG. 18.
Figure 20:
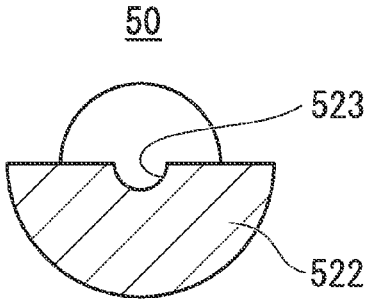
FIG. 20 is a front diagram of the auxiliary tool of FIG. 19, and is a cross-sectional diagram taken along line C-C of FIG. 19.
Figure 21:
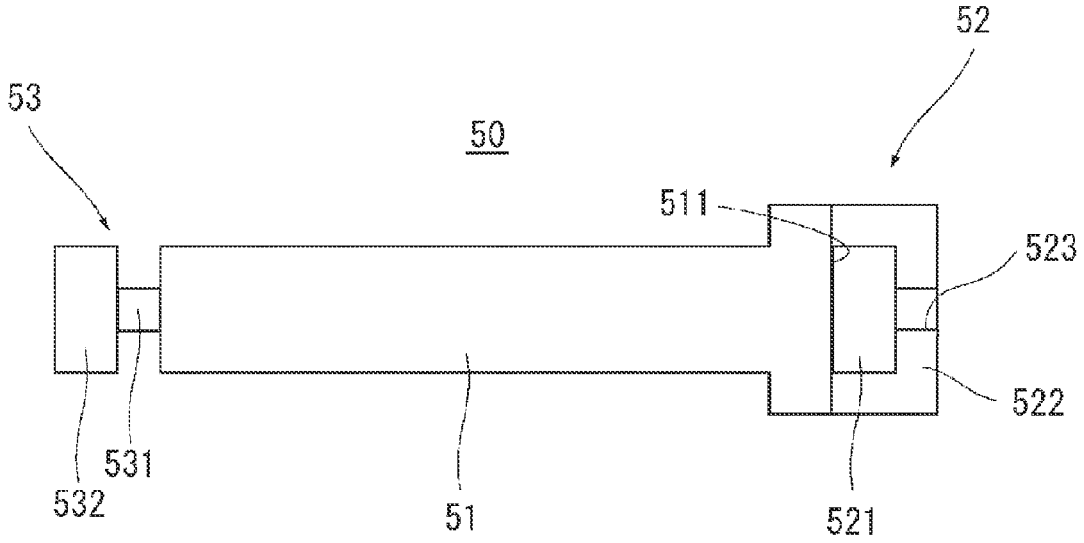
FIG. 21 is a plan diagram of the auxiliary tool of FIG. 19.

FIG. 19 is a vertical cross-sectional diagram of the auxiliary tool 50 in FIG. 18, FIG. 20 is a cross-sectional diagram when viewed from line C-C of FIG. 19, and FIG. 21 is a plan diagram. With reference to FIGS. 19 to 21, the auxiliary tool 50 includes a main body portion 51, a holding portion 52, and a mounting portion 53.

The main body portion 51 has a rod shape, and preferably, the cross-sectional shape of the main body portion is a circle. The material of the main body portion 51 is not particularly limited, and is preferably metal.

The holding portion 52 is disposed at the front end of the main body portion 51. The holding portion 52 is fitted to the flange 420 and the neck 410 of the rear end of the mandrel bar 40. That is, the auxiliary tool 50 is mounted on the mandrel bar 40 to be coaxial with the mandrel bar 40 by the holding portion 52.

The holding portion 52 includes a groove 521 and a hook portion 522. The hook portion 522 is formed at an interval with a front end surface 511 in the front of the front end surface 511 of the main body portion 51. In the present example, a groove 523 fitted to the neck 410 is formed on the upper surface of the hook portion 522.

The groove 521 is formed between the hook portion 522 and the front end surface 511, and extends in a transverse direction of the auxiliary tool 50. More specifically, the groove 521 extends in an arcuate shape or an arc shape in the circumferential direction of the auxiliary tool 50. The width of the groove 521 is slightly larger than the width of the flange 420. The groove 521 is fitted to the flange 420.

The holding portion 52 is held to the rear end of the mandrel bar 40 by the groove 521 and the hook portion 522.

The mounting portion 53 has a shape which can be held by the holding member 316 of the retaining system 31. Preferably, the mounting portion 53 has the same shape as the rear end of the mandrel bar 40. The mounting portion 53 includes a neck 531 and a flange 532. The neck 531 and the flange 532 have the same shapes as the neck 410 and the flange 420 of the mandrel bar 40. The mounting portion 53 is fitted to the holding member 316 of the retaining system 31. Accordingly, the auxiliary tool 50 is fixed to the holding member 316.

With reference to FIG. 18, the holding portion 52 of the auxiliary tool 50 holds the rear end (neck 410 and flange 420) of the mandrel bar 40, and is fixed to and detached from the mandrel bar 40. In addition, the mounting portion 53 of the auxiliary tool 50 is fitted to the holding member 316, and is fixed to and detached from the holding member 316.

In brief, the auxiliary tool 50 supplements the length of the mandrel bar 40. The auxiliary tool 50 plays the same role as the extension portion 402, and extends the extension portion 402. Accordingly, the total length of the mandrel bar 40 prepared in advance can be shortened.

Preferably, even when the plurality of mandrel bars 40 have outer diameters different from one another, the shapes of the rear ends (necks 410 and flanges 420) are the same as one another. In this, the holding portion 52 of the auxiliary tool 50 can hold the mandrel bar 40 having various sizes (outer diameters). Accordingly, the auxiliary tool 50 can be used in common by the plurality of mandrel bars 40 which have different sizes. Therefore, the total length of the plurality of mandrel bars 40 can be shortened.

The manufacturing process of the seamless metal pipe of the present embodiment is as follows. With reference to FIG. 14, in Step S5, the auxiliary tool 50 is mounted on the holding member 316 of the retaining system 31. Thereafter, the mandrel bar 40 selected in Step S2 is mounted on the auxiliary tool 50. According to the processes, the auxiliary tool 50 is mounted on the rear end of the mandrel bar 40. The retaining system 31 inserts the mandrel bar 40 on which the auxiliary tool 50 is mounted into the hollow shell HS. Other operations are the same as those of the first embodiment. In addition, after the auxiliary tool 50 is mounted on the mandrel bar 40, the auxiliary tool 50 may be mounted on the holding member 316.

In the present embodiment, only one kind of auxiliary tool 50 may be prepared, or a plurality of kinds of auxiliary tools 50 having outer diameters different from one another may be prepared. When the plurality of kinds of auxiliary tools 50 are prepared, in Step S2 of FIG. 14, an optimal mandrel bar 40 and auxiliary tool 50 are selected.

Figure 22:
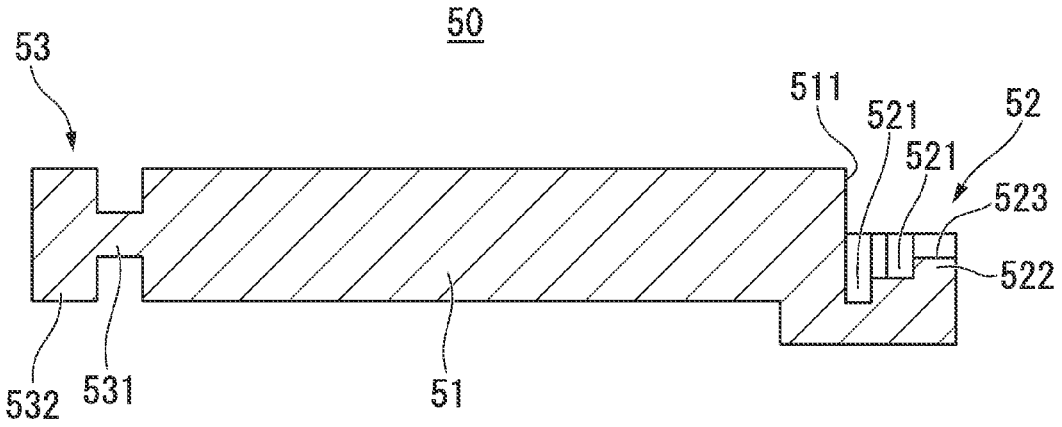
FIG. 22 is a diagram showing a modification of the auxiliary tool of FIG. 19, and is a vertical cross-sectional diagram of the auxiliary tool having a plurality of grooves.
Figure 23:
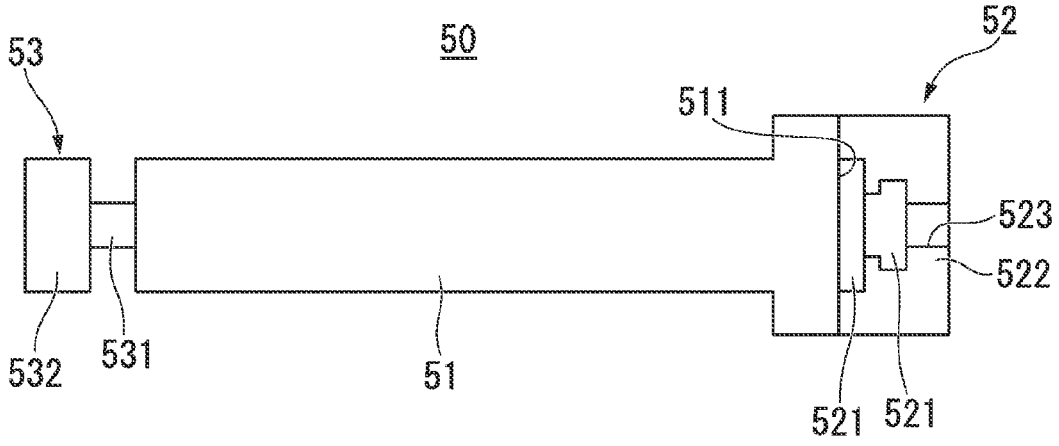
FIG. 23 is a plan diagram of the auxiliary tool.

In addition, in the present embodiment, the holding portion 52 includes one groove 521. However, as shown in FIGS. 22 and 23, the holding portion 52 may include a plurality of grooves having sizes different from one another. In this case, for example, the holding portion 52 includes a plurality of grooves which are arranged in a line in the axial direction. The groove is small as it approaches the hook portion 522. In this case, the holding portion 52 can hold the plurality of mandrel bars 40 having different sizes from one another in the rear end. The plurality of grooves are formed corresponding to each rear end of the plurality of mandrel bars which have sizes different from one another. Accordingly, the holding portion 52 can hold even the mandrel bars which have different sizes from one another in the rear end.

Moreover, the configuration of the holding portion 52 is not limited to FIGS. 19 to 21. For example, the holding portion 52 includes an openable and closable arm, and the mandrel bar 40 may be held by interposing the rear end of the mandrel bar 40 between arms by opening and closing the arms. Also in this case, one auxiliary tool 50 can hold the plurality of mandrel bars 40 having outer diameters different from one another. The holding portion 52 may have the same configuration as the holding member 316.

Fourth Embodiment

When the auxiliary tool 50 is applied to the plurality of mandrel bars 40 having sizes different from one another, the outer diameter of the auxiliary tool 50 may be different from the outer diameter of the mandrel bar 40. Also in this case, it is preferable that the elongating is appropriately performed.

Figure 24:
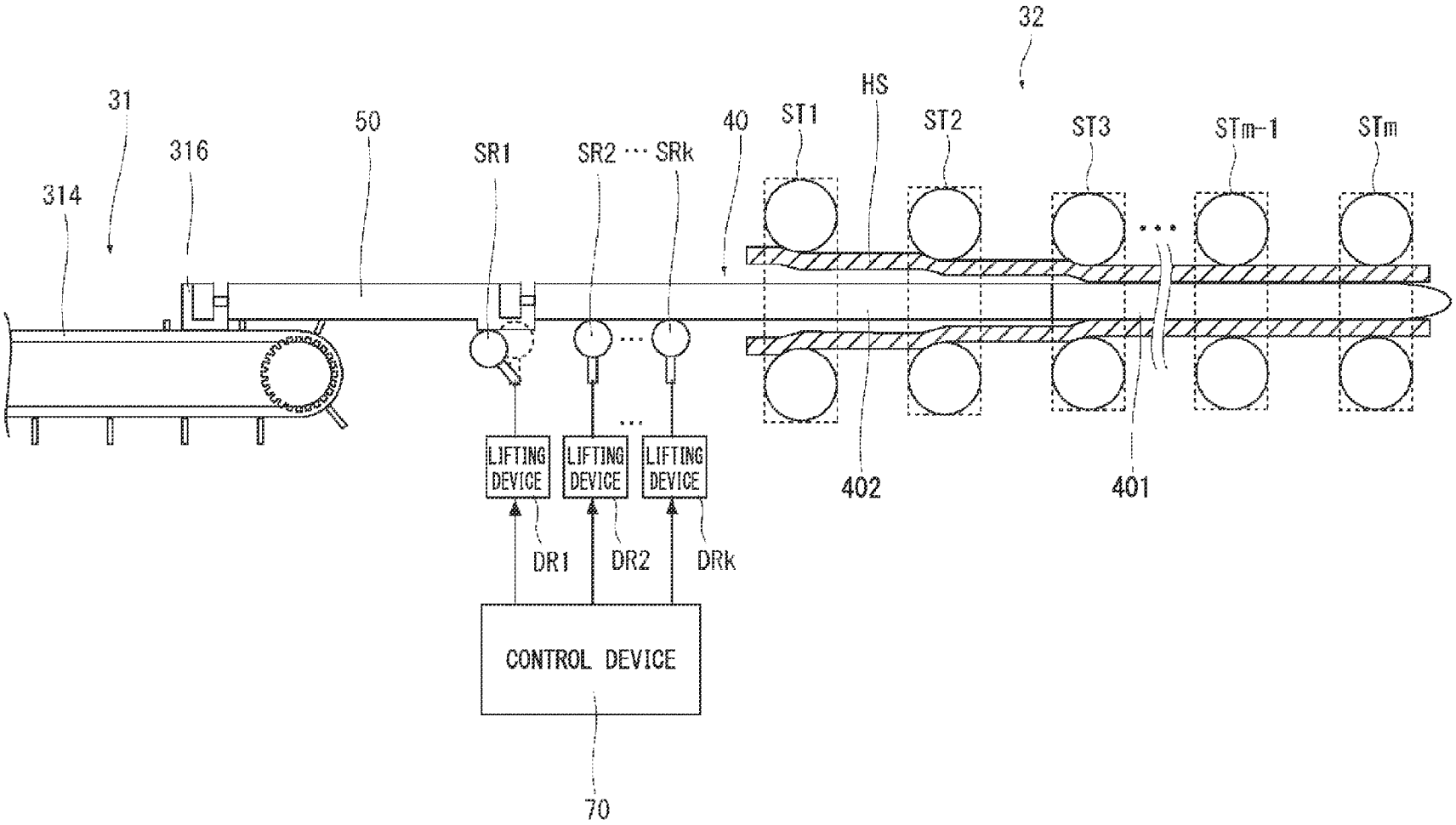
FIG. 24 is a schematic diagram showing the elongating in the mandrel mill when the auxiliary tool of FIG. 19 and a support roll are used.

With reference to FIG. 24, compared to the third embodiment, the mandrel mill 3 according to the present embodiment further includes a control device 70.

The control device 70 controls lifting and lowering of a plurality of support rolls SR1 to SRk (k is a natural number).

The support rolls SR1 to SRk are arranged along the pass line between the retaining system 31 and the rolling mill body 32. For example, each of the support rolls may be a roll having a flat outer circumferential surface, and may be a V roll which has a groove having a triangular cross-sectional shape in the circumferential direction of the outer circumferential surface.

The support rolls SR1 to SRk are lifted and lowered up and down by lifting devices DR1 to DRk. For example, each of the lifting devices DR1 to DRk is a hydraulic cylinder, an electric cylinder, or the like. In FIG. 24, one lifting device DR is disposed in each support roll SR. However, one lifting device DR may be disposed in the plurality of support rolls SR.

The control device 70 controls the lifting devices DR1 to DRk, and lifts and lowers the support rolls SR1 to SRk. The retaining system 31 and the rolling mill body 32 are apart from each other. Accordingly, the mandrel bar 40 may be curved downward between the retaining system 31 and the rolling mill body 32. This curvature influences the stable transport of the mandrel bar during the rolling and dimensional accuracy of the hollow shell HS after the elongating. Accordingly, the support rolls SR1 to SRk are lifted according to the positions of the mandrel bar 40 during the elongating, and the mandrel bar 40 is supported on the pass line PL.

However, as described above, when the auxiliary tool 50 is used in common, the outer diameter of the auxiliary tool 50 may be different from the outer diameter of the mandrel bar 40. In this case, the lower end position of the mandrel bar 40 during the elongating is different from the lower end position of the auxiliary tool 50. If the height of the support roll SR is maintained while being matched to the height of the lower end position of the mandrel bar 40, a gap may occur between the support roll SR and the auxiliary tool 50, or the auxiliary tool 50 may collide with the support roll SR.

Accordingly, the control device 70 adjusts the height of the support roll according to the movement distance (forward movement distance) of the auxiliary tool 50 during the elongating. Specifically, when the outer diameter of the auxiliary tool 50 is larger than the outer diameter of the mandrel bar 40, the control device controls the lifting device DRq and lowers the support roll SRq before the auxiliary tool 50 passes through the support roll SRq (q is a natural number of 1 to k). At this time, the control device 70 may determine a lowering amount based on a difference value between the outer diameter of the auxiliary tool 50 and the outer diameter of the mandrel bar 40. In this case, the control device can lower the support roll SRq to an extent that the support roll SRq comes into contact with the lower end of the auxiliary tool 50 after the lowering.

On the other hand, when the outer diameter of the auxiliary tool 50 is smaller than the outer diameter of the mandrel bar 40, the control device controls the lifting device DRq and lifts the support roll SRq after the auxiliary tool 50 passes through the support roll SRq. At this time, the control device 70 may determine the lifting amount based on the difference value between the outer diameter of the auxiliary tool 50 and the outer diameter of the mandrel bar 40. In this case, the control device can lift the support roll SRq to an extent that the support roll SRq comes into contact with the lower end of the auxiliary tool 50 after the lifting.

As described above, the control device 70 lifts and lowers the support roll SRq and adjusts the height of the support roll SRq according to the movement distance of the auxiliary tool 50. Accordingly, collision of the auxiliary tool 50 with respect to the support roll SR can be suppressed. Moreover, preferably, considering the outer diameter difference between the auxiliary tool 50 and the mandrel bar 40, the control device 70 lifts and lowers the support roll SRq. In this case, the auxiliary tool 50 can be supported by the support roll SRq.

The details of the manufacturing process of the present embodiment are as follows.

Figure 25:
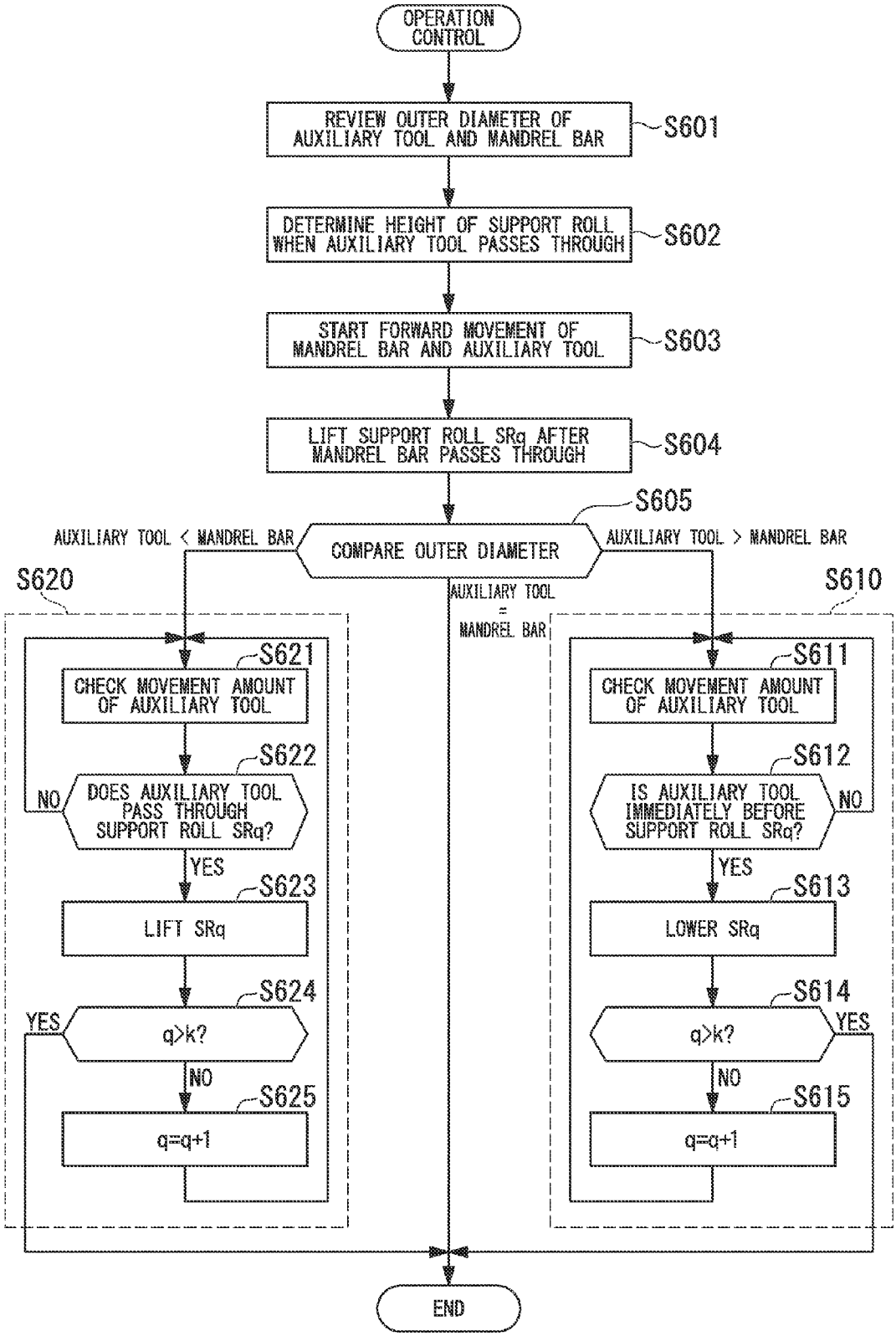
FIG. 25 is a flowchart showing an operation of a control device in FIG. 24.

The operations of Step S1 to S7 in FIG. 14 are also performed in the present embodiment. The control device 70 performs an operation shown in FIG. 25 during the elongating of Step S6.

First, the control device 70 reads the outer diameter of the auxiliary tool 50 and the outer diameter of the mandrel bar 40, and compares the outer diameters (Step S601). At this time, the control device 70 obtains the difference value between the outer diameter of the auxiliary tool 50 and the outer diameter of the mandrel bar 40. Subsequently, the control device determines the height of the support roll SRq when the auxiliary tool 50 passes through the support roll SRq (Step S602). Every time the mandrel bar 40 and the auxiliary tool 50 are combined with each other, the control device 70 may manage the height of the support roll SRq on a table in advance and store the table in the memory.

The control device 70 confirms the movement starts of the mandrel bar 40 and the auxiliary tool 50 (Step S603). For example, when the forward movement of the holding member 316 starts in the elongating, the retaining system 31 notifies the control device 70 accordingly. The control device 70 receives the notification and recognizes the movement start of the auxiliary tool 50 and the like (Step S603).

The control device 70 lifts the support roll SRq every time the mandrel bar 40 passes through the support roll SRq (Step S604). At this time, the control device 70 determines the lifting amount of the support roll SRq according to the size (outer diameter) of the mandrel bar 40.

According to the above-described operations, the mandrel bar 40 during the elongating is supported by the support rolls SR1 to SRk.

Subsequently, the control device 70 reads the reviewed results of Step S601 (Step S605). When the outer diameter of the auxiliary tool 50 is the same as the outer diameter of the mandrel bar 40, it is not necessary to adjust the height of the support roll SRq. Accordingly, the control device 70 maintains the height of the support roll SRq as it is until the elongating of one hollow shell HS ends.

On the other hand, when the outer diameter of the auxiliary tool 50 is larger than the outer diameter of the mandrel bar 40, the control device 70 performs the lowering processing of the support roll (Step S610). Specifically, the control device 70 checks the present movement amount of the auxiliary tool 50 (Step S611). For example, the control device 70 receives the notification of the movement amount of the holding member 316 for each predetermined time from the retaining system 31, and recognizes the movement amount (forward movement amount) of the auxiliary tool 50.

When the auxiliary tool 50 reaches near a predetermined distance of the support roll SR1 (YES in Step S612), the control device 70 lowers the support roll SR1 based on the movement amount of the auxiliary tool 50 checked in Step S611. At this time, the control device 70 may lower the support roll SR1 so that the support roll is separated from the auxiliary tool 50. In addition, the control device 70 may lower the support roll SR1 so that the support roll SR1 comes into contact with the auxiliary tool 50 based on an outer diameter difference between the auxiliary tool 50 and the mandrel bar 40.

After the support roll SR1 is lowered, an increment of the counter q is performed (Step S615), and it is returned to Step S611. Until the counter q exceeds k (YES in Step S614), that is, operations S611 to S613 are performed on each of the support rolls SR1 to SRk.

According to the above-described operations, when the outer diameter of the auxiliary tool 50 is larger than the outer diameter of the mandrel bar 40, the control device 70 lowers the support roll SRq. Accordingly, it is possible to suppress collision of the auxiliary tool 50 with respect to the support roll SRq.

Return to Step S605, when the outer diameter of the auxiliary tool 50 is smaller than the outer diameter of the mandrel bar 40, the lifting processing of the support roll is performed (Step S620). The control device 70 checks the present movement amount of the auxiliary tool 50 for each predetermined time (Step S621).

When the auxiliary tool 50 passes through a predetermined distance of the support roll SR1 (YES in Step S622), the control device 70 lifts the support roll SR1 by a predetermined amount based on the movement amount of the auxiliary tool 50 checked in Step S621. At this time, the control device 70 lifts the support roll SR1 by a predetermined amount so that the support roll SR1 comes into contact with the auxiliary tool 50 based on the outer diameter difference between the auxiliary tool 50 and the mandrel bar 40.

Thereafter, similar to the lowering processing of the support roll S610, operations Step S621 to S623 are performed on each of the support rolls SR1 to SRk (Step S624 and S625).

According to the above-described operations, when the outer diameter of the auxiliary tool 50 is smaller than the outer diameter of the mandrel bar 40, the control device 70 lifts the support roll SRq by a predetermined amount and causes the support roll SRq to come into contact with the auxiliary tool 50. The auxiliary tool 50 can move forward without being curved downward.

In the above-described example, the control device 70 performs the lowering processing S610 of the support roll and the lifting processing S620 of the support roll. However, the control device 70 may perform only the lowering processing S610 of the support roll. In addition, the control device 70 may lower the support roll SRq by a constant amount regardless of the outer diameter of the auxiliary tool 50 in the lowering processing S610 of the support roll. In this case, at least the collision of the auxiliary tool 50 with respect to the support roll SRq can be suppressed, and more appropriate elongating can be performed.

In the above-described embodiment, the processing of Step S611 to S613 is performed on each of the support rolls SR1 to SRk. However, a plurality of support rolls SR may be lowered at once. Moreover, all support rolls SR1 to SRk may be lowered at once.

In the above-described embodiment, the plurality of support rolls SR1 to SRk are disposed between the retaining system 31 and the head stand ST1 of the rolling mill body 32. However, one or more support rolls may be disposed.

In the above, the present embodiments are described. However, the present embodiments are not limited to the above-described embodiments.

In the fourth embodiment, the support rolls SR1 to SRk are disposed. However, in the first to third embodiments, the support rolls SR1 to SRk may be not present.

In the above-described embodiments, the mandrel bar 40 is inserted into the hollow shell HS by the retaining system 31. However, the mandrel bar 40 may be inserted into the hollow shell HS according to other methods. For example, the mandrel bar 40 may be inserted into the hollow shell HS by an inserter which is a device differing from the retaining system 31.

The holding member 316 of the retaining system 31 is not limited to the above-described configuration. For example, the holding member 316 may include a plurality of arms which can be opened and closed. In this case, the holding member 316 may hold the mandrel bar 40 by interposing the rear end of the mandrel bar 40 between the arms.

In the above-described embodiments, the rear end of the mandrel bar 40 includes the neck 410 and the flange 420. However, the shape of the rear end of the mandrel bar 40 is not limited to this. In brief, the shape of the rear end portion of the mandrel bar 40 is not particularly limited if the rear end has a shape which can hold the holding member 316 and the holding portion 52 of the auxiliary tool 50.

In the above, the embodiments of the present invention are described. However, the above-described embodiments are only exemplary examples of the present invention. Accordingly, the present invention is not limited to only the above-described embodiments, and the above-described embodiments can be appropriately modified within a scope which does not depart from the gist thereof. For example, in the above-described embodiments, the mandrel mill includes the preceding-stage stand group performing the outer diameter reduction or the thickness reduction, and the succeeding-stage stand group performing the thickness reduction, and performs the elongating on the hollow shell. However, the mandrel mill may include a stand which does not perform the outer diameter reduction and the thickness reduction. That is, the stand used in the preceding-stage stand group and the succeeding-stage stand group may be appropriately selected from the stands of the mandrel mill if necessary.

INDUSTRIAL APPLICABILITY

It is possible to provide a manufacturing method and a manufacturing apparatus of a seamless metal pipe capable of increasing production efficiency by increasing the operating ratio of a manufacturing line.

BRIEF DESCRIPTION OF THE REFERENCE SYMBOLS

2: piercing mill
3: mandrel mill
31: retaining system
32: rolling mill body
40: mandrel bar
HS: hollow shell
ST1 to STm: stand
FST: preceding-stage stand group
RST: succeeding-stage stand group

The invention claimed is:

1. A manufacturing method of a seamless metal pipe which manufactures a seamless metal pipe from a hollow shell using a mandrel mill having a preceding-stage stand group including a plurality of stands arranged from a head along a pass line and a succeeding-stage stand group including a plurality of stands arranged behind the preceding-stage stand group, the manufacturing method comprising:

inserting a mandrel bar into the hollow shell;

determining whether the preceding-stage stand group performs outer diameter reduction or thickness reduction of the hollow shell; and performing elongating on the hollow shell, into which the mandrel bar is inserted, by the preceding-stage stand group and the succeeding-stage stand group, based on the determination whether the preceding-stage stand group performs the outer diameter reduction or the thickness reduction of the hollow shell, wherein in the elongating, when the preceding-stage stand group is determined to perform the outer diameter reduction, the hollow shell is rolled in a state where an inner surface of the hollow shell does not come into contact with the mandrel bar in the preceding-stage stand group, and the hollow shell is rolled in a state where the inner surface of the hollow shell comes into contact with the mandrel bar in the succeeding-stage stand group, and wherein in the elongating, when the preceding-stage stand group is determined to perform the thickness reduction, the hollow shell is rolled in the state where the inner surface of the hollow shell comes into contact with the mandrel bar in both the preceding-stage stand group and the succeeding-stage stand group, and wherein the determination whether the preceding-stage stand group performs outer diameter reduction or thickness reduction of the hollow shell is made based on a grade of the seamless metal pipe to be manufactured and a size of the seamless metal pipe.

2. The manufacturing method of a seamless metal pipe according to claim 1, further comprising:

determining the number of stands when the preceding-stage stand group performs the outer diameter reduction, according to at least one of a steel grade of the seamless metal pipe and a size of the seamless metal pipe.

3. A manufacturing apparatus of a seamless metal pipe comprising:

a rolling mill body which includes a preceding-stage stand group including a plurality of stands arranged from a head along a pass line and a succeeding-stage stand group including a plurality of stands arranged behind the preceding-stage stand group;

a setting unit which sets whether the preceding-stage stand group of the rolling mill body performs outer diameter reduction or thickness reduction of a hollow shell; and a retaining system which inserts a mandrel bar into the hollow shell, wherein when the preceding-stage stand group is set to perform the outer diameter reduction by the setting unit, the preceding-stage stand group rolls the hollow shell in a state where an inner surface of the hollow shell does not come into contact with the mandrel bar, and the succeeding-stage stand group rolls the hollow shell in a state where the inner surface of the hollow shell comes into contact with the mandrel bar, and wherein when the preceding-stage stand group is set to perform the thickness reduction by the setting unit, the preceding-stage stand group and the succeeding-stage stand group roll the hollow shell in the state where the inner surface of the hollow shell comes into contact with the mandrel bar, and wherein the setting unit sets whether the preceding-stage stand group of the rolling mill body performs outer diameter reduction or thickness reduction of the hollow shell, based on a grade of the seamless metal pipe to be manufactured and a size of the seamless metal pipe.

* * * * *